US006779495B2

(12) United States Patent
Yamada et al.

(10) Patent No.: US 6,779,495 B2
(45) Date of Patent: Aug. 24, 2004

(54) VARIABLE COMPRESSION RATIO ENGINE

(75) Inventors: Yoshikazu Yamada, Wako (JP); Sei Watanabe, Wako (JP); Akihisa Shinoda, Wako (JP); Mashu Kurata, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/384,786

(22) Filed: Mar. 11, 2003

(65) Prior Publication Data

US 2003/0209212 A1 Nov. 13, 2003

(30) Foreign Application Priority Data

Mar. 20, 2002 (JP) ..... 2002-079739

(51) Int. Cl.[7] ..... F02B 75/04
(52) U.S. Cl. ..... 123/78 E; 123/48 B; 123/78 F
(58) Field of Search ..... 123/48 B, 78 F, 123/78 E

(56) References Cited

U.S. PATENT DOCUMENTS 4,475,495 A 10/1984 Lydell ..... 123/194
6,561,142 B2 * 5/2003 Moteki et al. ..... 123/48 B

FOREIGN PATENT DOCUMENTS

| | | |
|---|---|---|
| EP | 2000073804 | 3/2000 |
| GB | 321684 | 11/1929 |
| GB | 558851 | 1/1944 |
| JP | 2000-73804 | 3/2000 |

* cited by examiner

*Primary Examiner*—Zalelem Eshete
(74) *Attorney, Agent, or Firm*—Arent Fox PLLC

(57) ABSTRACT

A variable compression ratio engine includes a support shaft positioned eccentrically relative to rotating shafts. A restricting projection is provided at one location in the circumferential direction on the rotating shafts so as to project outward in the radial direction. A rocker member has a pair of engagement portions with respective phases displaced from each other and which engage the restricting projection. The rocker member is spring-biased in a direction in which one of the two engagement portions engages the restricting projection and is mounted on a shaft member so as to be able to rock around the axis of the shaft member. An actuator is driven by the engine negative pressure and is connected to the rocker member so as to swing the rocker member in a direction opposite to the spring-bias direction.

4 Claims, 30 Drawing Sheets

VARIABLE COMPRESSION RATIO ENGINE

BACKGROUND OF THE INVENTION

1. Field of the Invention

The present invention relates to a variable compression ratio engine wherein one end of a connecting rod is connected to a piston via a piston pin and the other end of the connecting rod is swingably connected to one end of a sub-rod that is in sliding contact with half of the periphery of a crankpin of a crankshaft. A crank cap in sliding contact with the other half of the periphery of the crankpin is secured to the sub-rod, and one end of a control rod is swingably connected to the other end of the sub-rod.

2. Description of the Related Art

Conventionally, such a variable compression ratio engine is already known from, for example, Japanese Patent Application Laid-open No. 2000-73804 in which the position of one end of a control rod connected at the other end to a sub-rod is changed to vary the compression ratio according to the running conditions of the engine.

In this conventional arrangement, the position of the control rod is changed using an electrical or hydraulic device. As a result, the dimensions of the engine increase and the structural arrangement becomes rather complicated. Moreover, in order to operate the electrical or hydraulic device, the engine is required to drive any drive device, which involves a power loss of the engine.

SUMMARY OF THE INVENTION

It is an object of the present invention to provide a variable compression ratio engine that allows the position of a control rod to be changed with minimal power loss of the engine while avoiding an increase in the dimensions of the engine and preventing the structural arrangement from becoming complicated.

In accordance with a first aspect of the present invention, there is proposed a variable compression ratio engine wherein one end of a connecting rod is connected to a piston via a piston pin and the other end of the connecting rod is swingably connected to one end of a sub-rod that is in sliding contact with half of the periphery of a crankpin of a crankshaft. A crank cap in sliding contact with the other half of the periphery of the crankpin is secured to the sub-rod, and one end of a control rod is swingably connected to the other end of the sub-rod. The other end of the control rod is swingably connected to a support shaft provided at an eccentric position relative to a rotating shaft that is swingably and axially supported in an engine main body via a one-way clutch. An actuator supported in the engine main body is a diaphragm-type actuator in which the peripheral edge of a diaphragm is sandwiched by a casing. Opposite sides of the diaphragm face a negative pressure chamber that is in communication with an intake passage within a carburetor mounted on the engine main body and an atmospheric pressure chamber that is opened to the atmosphere, respectively. A restricting projection is provided at one location in the circumferential direction on the rotating shaft so as to project outward in the radial direction. A shaft member is provided in the engine main body so that the axis of the shaft member is perpendicular to the rotating shaft. A rocker member mounted on the shaft member is able to rock around the axis of the shaft member and has a pair of engagement portions having phases displaced from each other. The engagement portions can engage the restricting projection and are spring-biased in a direction so that one of the two engagement portions engages the restricting projection. The actuator is connected to the rocker member so as to make the rocker member swing in a direction opposite to the spring-bias direction in response to an increase in the negative pressure of the negative pressure chamber.

In accordance with such an arrangement of the first aspect, a load in a direction in which the control rod is compressed and a load in a direction in which the control rod is pulled alternately act on the support shaft provided on the rotating shaft according to the running cycle of the engine. Therefore, a load to rotate the rotating shaft in one direction and a load to rotate it in the other direction are alternately applied to the rotating shaft. However, the one-way clutch disposed between the rotating shaft and the engine main body only allows the rotating shaft to rotate in one direction. Further, the restricting projection provided on the rotating shaft engages one of the engagement portions provided on the rocker member so that the axis of the shaft member is perpendicular to the rotating shaft. The rocker member is spring-biased in a direction in which one of the engagement portions engages the restricting projection. The rocker member is swung by the actuator in a direction in which the other engagement portion engages the restricting projection. Therefore, the position of the other end of the control rod is changeable between a position corresponding to a high compression ratio and a position corresponding to a low compression ratio. Moreover, since the diaphragm type actuator is operated by the negative pressure of the intake passage within the carburetor, the position of the control rod can be changed with minimal power loss of the engine while avoiding an increase in the dimensions of the engine and preventing the structural arrangement from becoming complicated.

Furthermore, in accordance with a second aspect of the present invention, there is proposed a variable compression ratio engine wherein each engagement portion of the rocker member includes a plurality of steps arranged in the circumferential direction of the rotating shaft so that each of the steps sequentially engages the restricting projection as the rotating shaft rotates. In accordance with such an arrangement, the compression ratio is varied with finer or more accurate differentiation by engaging the restricting projection with the respective steps.

In accordance with a third aspect of the present invention, there is proposed a variable compression ratio engine wherein one end of a connecting rod is connected to a piston via a piston pin and the other end of the connecting rod is swingably connected to one end of a sub-rod that is in sliding contact with half of the periphery of a crankpin of a crankshaft. A crank cap in sliding contact with the remaining half of the periphery of the crankpin is secured to the sub-rod, and one end of a control rod is swingably connected to the other end of the sub-rod. The other end of the control rod is swingably connected to a support shaft provided at an eccentric position relative to a rotating shaft that is swingably and axially supported in an engine main body via a one-way clutch. An actuator supported in the engine main body is a diaphragm-type actuator in which the peripheral edge of a diaphragm is sandwiched by a casing. Opposite sides of the diaphragm face a negative pressure chamber that is in communication with an intake passage within a carburetor mounted on the engine main body and an atmospheric pressure chamber that is opened to the atmosphere, respectively. Engagement portions having phases displaced from each other are provided on the rotating shaft in a plurality of locations in the axial direction. A shaft member is provided in the engine main body so that the axis of the shaft member is perpendicular to the rotating shaft. A restricting member having a restricting projection that selectively engages the plurality of engagement portions is mounted on the shaft member so that the restricting projection is operated within a plane perpendicular to the axis of the shaft member. The actuator is connected to the restricting member to drive the restricting member within the plane that is perpendicular to the axis of the shaft member.

In accordance with such an arrangement of the third aspect, a load in a direction in which the control rod is compressed and a load in a direction in which the control rod is pulled alternately act on the support shaft provided on the rotating shaft according to the running cycle of the engine. Therefore, a load that rotates the rotating shaft in one direction and a load that rotates the rotating shaft in the other direction are alternately applied to the rotating shaft. However, the one-way clutch disposed between the rotating shaft and the engine main body only allows the rotating shaft to rotate in one direction. Further, the engagement portions have phases displaced from each other and are provided on the rotating shaft in a plurality of locations in the axial direction. The engagement portions selectively engage the restricting projection of the restricting member operating within a plane perpendicular to the axis of the shaft member supported on the engine main body so as to have the axis of the shaft member perpendicular to the rotating shaft. The restricting member can be operated by the actuator. Therefore, the position of the other end of the control rod can be changed along a plurality of positions corresponding to a plurality of compression ratios. Moreover, since the diaphragm-type actuator is operated by the negative pressure of the intake passage within the carburetor, the position of the control rod can be changed with minimal power loss of the engine while avoiding an increase in the dimensions of the engine and preventing the structural arrangement from becoming complicated.

Furthermore, in accordance with a fourth aspect of the present invention, there is proposed a variable compression ratio engine wherein the shaft member is supported in the engine main body so as to be able to swing around the axis of the shaft member, and wherein a rack is provided on the restricting member that moves in a direction along the axis of the rotating shaft. The rack meshes with a pinion fixedly provided on the shaft member. In accordance with such an arrangement, the restricting member operates steplessly or continuously in the direction along the axis of the rotating shaft and causes the restricting projection to selectively engage with more engagement portions so as to vary the compression ratio with finer or more accurate differentiation.

The above-mentioned object, other objects, characteristics and advantages of the present invention will become apparent from an explanation of preferred embodiments that will be described in detail below by reference to the attached drawings.

DETAILED DESCRIPTION OF PREFERRED EMBODIMENTS

Figure 1:
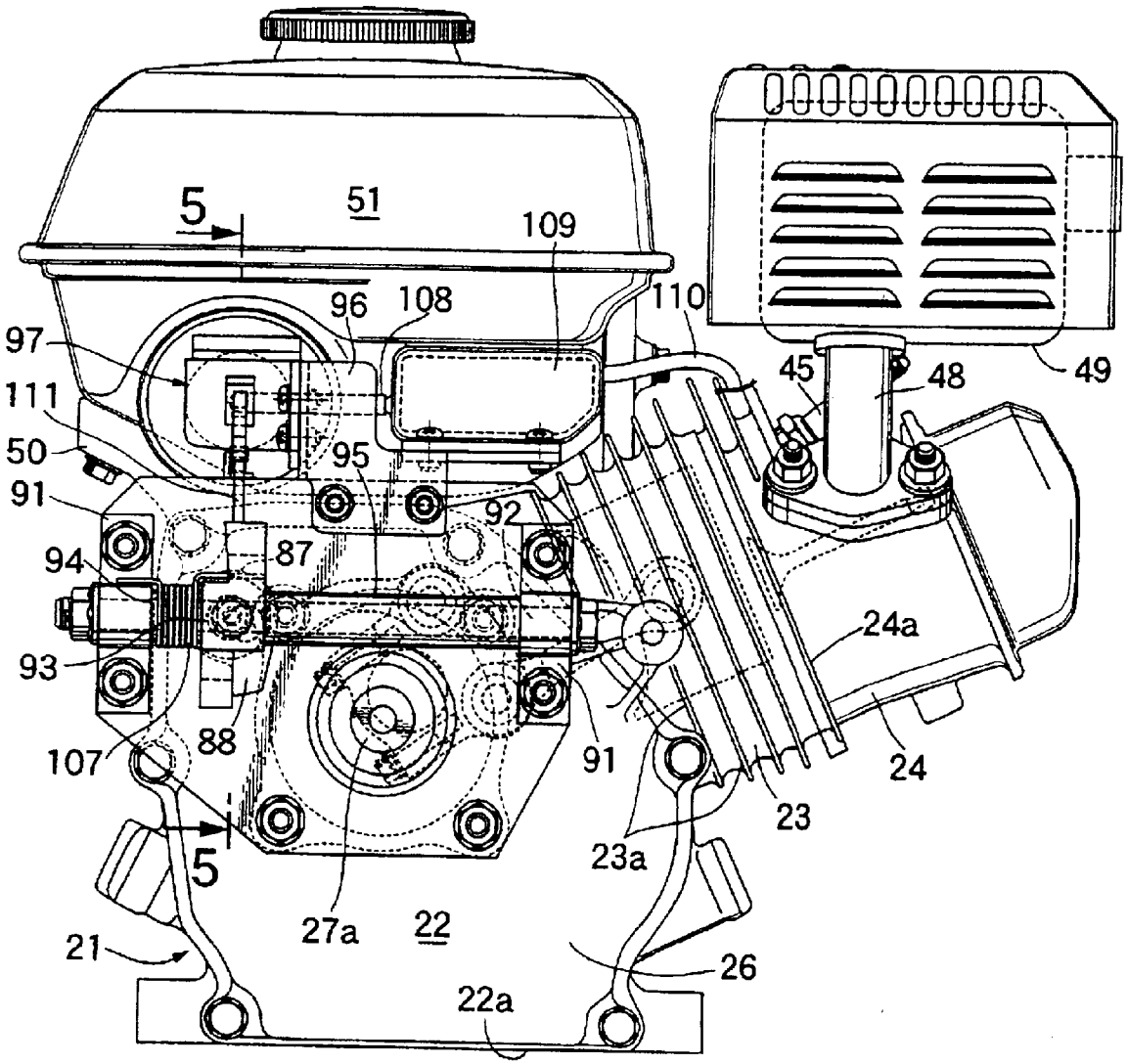
FIG. 1 is a front view of an engine.
Figure 2:
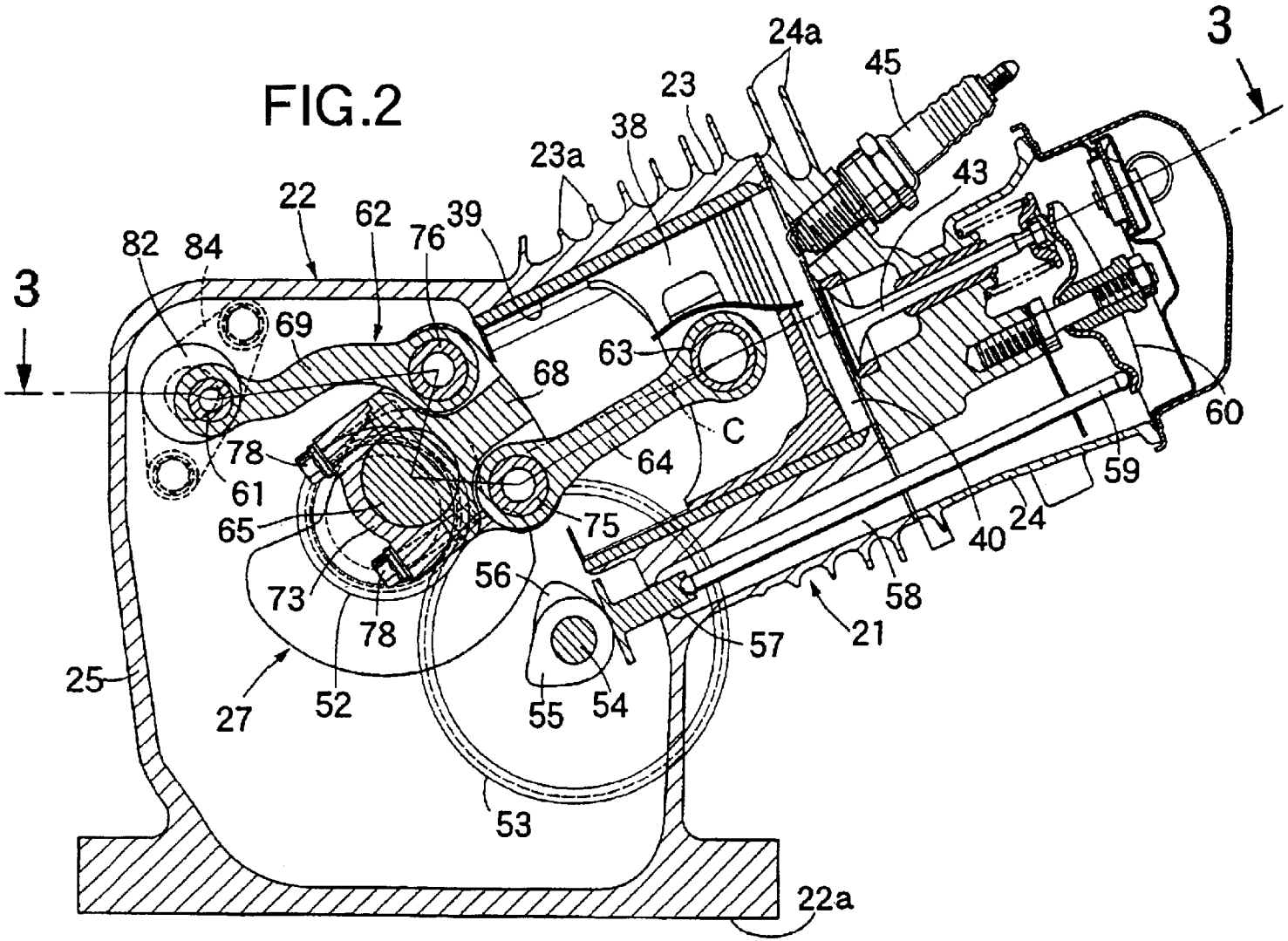
FIG. 2 is a longitudinal cross-sectional view of the engine taken along line 2—2 in FIG. 3.
Figure 3:
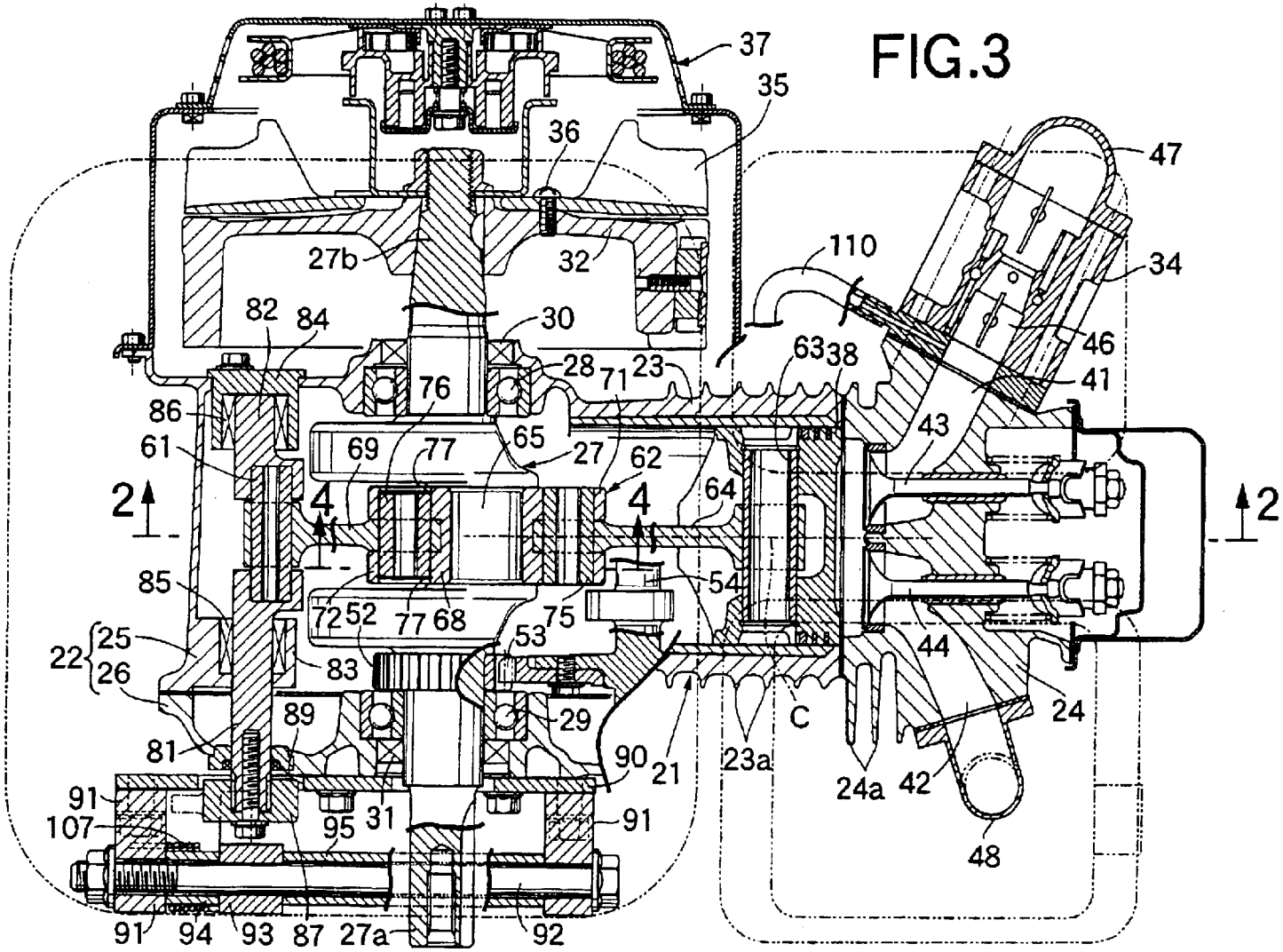
FIG. 3 is a cross-sectional view of the engine taken along line 3—3 in FIG. 2.

The first embodiment of the present invention is explained by reference to FIGS. 1 to 10. Firstly, referring to FIGS. 1 to 3, the illustrated engine is an air-cooled single cylinder engine used in, for example, work equipment. An engine main body 21 is formed from a crankcase 22, a cylinder block 23, and a cylinder head 24 joined to the head of the cylinder block 23. The cylinder block 23 is inclined slightly upward and projects from one side face of the crankcase 22. A large number of air-cooling fins 23*a*, 24*a* are provided on the outer side faces of the cylinder block 23 and the cylinder head 24. The crankcase 22 is mounted on an engine bed of various types of work equipment via a mounting face 22*a* on a lower face of the crankcase 22.

The crankcase 22 is formed from a case main body 25 and a side cover 26 joined to an open end of the case main body 25. The case main body 25 is mold-cast to be integral with the cylinder block 23. Opposite ends of a crankshaft 27 are rotatably supported in the case main body 25 and the side cover 26 via ball bearings 28, 29 and oil seals 30, 31. One end of the crankshaft 27 projects out of the side cover 26 and serves as an output shaft portion 27*a*, and the other end of the crankshaft 27 projects out of the case main body 25 and serves as an auxiliary equipment attachment shaft portion 27*b*. A flywheel 32 is fixed to the auxiliary equipment attachment shaft portion 27*b*. A cooling fan 35 is rigidly attached, by a screw 36, to the outside surface of the flywheel 32 and supplies cooling air to each part of the engine main body 21 and carburetor 34. A recoil type engine starter 37 is disposed outside the cooling fan 36.

Formed in the cylinder block 23 is a cylinder bore 39 in which a piston 38 is slidably fitted. Formed between the cylinder block 23 and the cylinder head 24 is a combustion chamber 40 that the top of the piston 38 faces.

Formed in the cylinder head 24 are an intake port 41 and an exhaust port 42 that communicate with the combustion chamber 40. An intake valve 43 and an exhaust valve 44 are arranged in the cylinder head 24. The intake valve 43 opens and closes a connection between the intake port 41 and the combustion chamber 40. The exhaust valve 44 opens and closes a connection between the exhaust port 42 and the combustion chamber 40. Screwed into the cylinder head 24 is a spark plug 45 with electrodes of the spark plug facing the combustion chamber 40.

The carburetor 34 is connected to an upper part of the cylinder head 24. The carburetor 34 has an intake passage 46 with a downstream end that communicates with the intake port 41. An intake pipe 47 communicating with the upstream end of the intake passage 46 is connected to the carburetor 34. The intake pipe 47 is connected to an air cleaner (not illustrated). An exhaust pipe 48 communicating with the exhaust port 42 is connected to an upper part of the cylinder head 24. The exhaust pipe 48 is connected to an exhaust muffler 49. A fuel tank 51, which is supported by a bracket 50 projecting from the crankcase 22, is disposed above the crankcase 22.

A drive gear 52 is integrally formed on the crankshaft 27 in a part close to the side cover 26 of the crankcase 22. A driven gear 53 that meshes with the drive gear 52 is fixedly attached to a camshaft 54 rotatably supported in the crankcase 22, wherein the axis of the camshaft 54 is parallel to the crankshaft 27. Rotational power from the crankshaft 27 is transmitted to the camshaft 54 at a reduction ratio of 1/2 via the meshed drive gear 52 and driven gear 53.

Provided on the camshaft 54 are an intake cam 55 and an exhaust cam 56 corresponding to the intake valve 43 and the exhaust valve 44, respectively. The intake cam 55 is in sliding contact with a follower 57 operably supported in the cylinder block 23. Formed in the cylinder block 23 and the cylinder head 24 is an operating chamber 58. An upper part of the follower 57 projects into a lower part of the operating chamber 58. A pushrod 59 is disposed within the operating chamber 58, a lower end of the pushrod 59 abutting against the follower 57. Rockably supported in the cylinder head 24 is a rocker arm 60, one end of which abuts against the upper end of the intake valve 43, which is spring-biased in a valve-closing direction. The upper end of the pushrod 59 abuts against the other end of the rocker arm 60. As a result, the pushrod 59 moves in the axial direction in response to rotation of the intake cam 55 so that rocking of the rocker arm 60 accompanying the movement causes the intake valve 43 to open and close.

The same mechanism as that between the intake cam 55 and the intake valve 43 is provided between the exhaust cam 56 and the exhaust valve 44 so that the exhaust valve 44 opens and closes in response to rotation of the exhaust cam 56.

Figure 4:
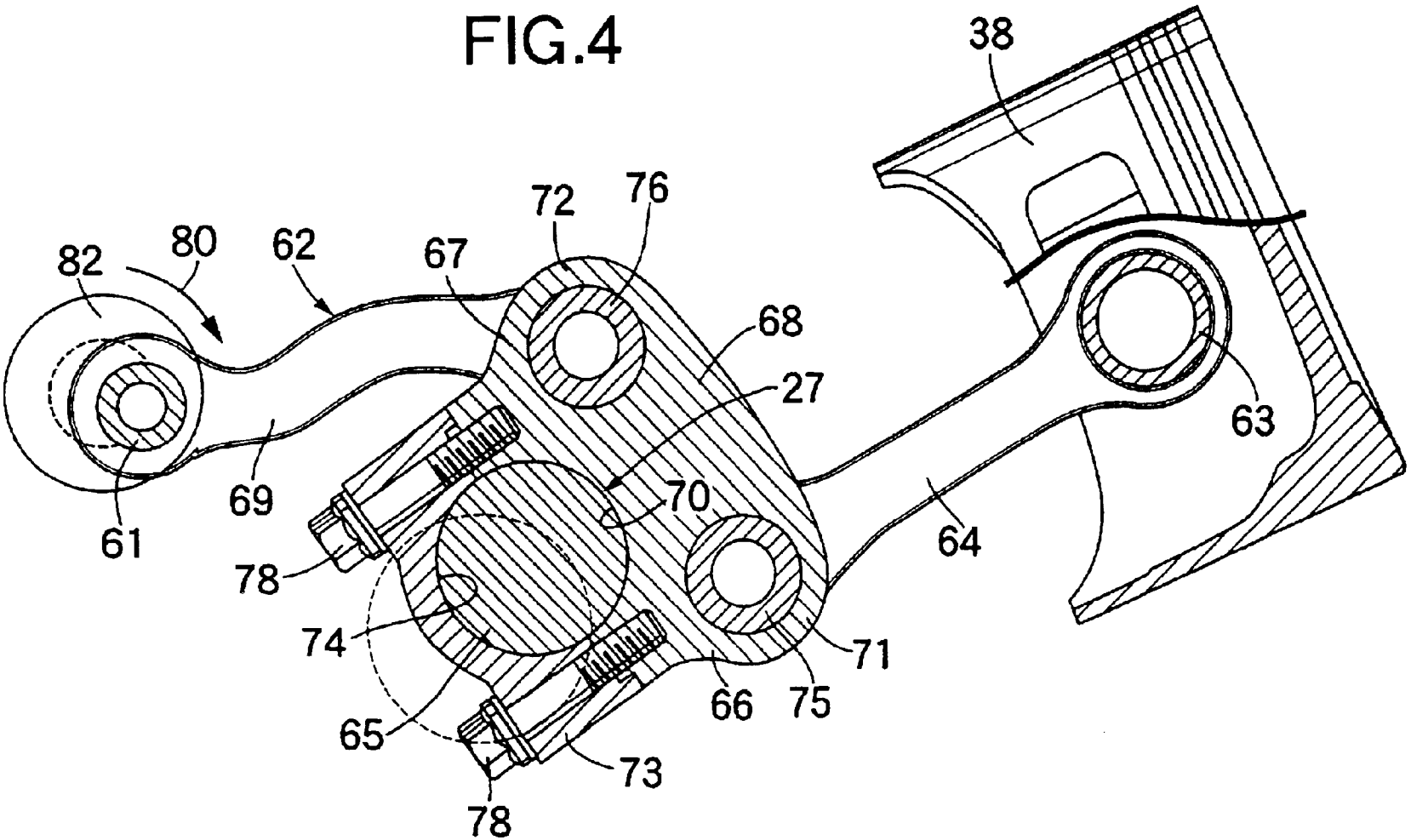
FIG. 4 is a cross-sectional view of the engine taken along line 4—4 in FIG. 3.

Referring also to FIG. 4, the piston 38, the crankshaft 27 and a support shaft 61 are connected via a link mechanism 62. The support shaft 61 is supported in the crankcase 22 of the engine main body 21 so as to be displaced within a plane that contains the cylinder axis C and that is perpendicular to the axis of the crankshaft 27.

The link mechanism 62 is formed from a connecting rod 64, a first arm 66, a second arm 67, and a control rod 69. One end of the connecting rod 64 is connected to the piston 38 via a piston pin 63. One end of the first arm 66 is swingably connected to the other end of the connecting rod 64. The other end of the first arm 66 is connected to a crankpin 65 of the crankshaft 27. One end of the second arm 67 is integrally connected to the other end of the first arm 66. One end of the control rod 69 is swingably connected to the other end of the second arm 67, and the other end of the control rod 69 is swingably connected to the support shaft 61. The first and second arms 66, 67 are formed integrally as a sub-rod 68.

A middle section of the sub-rod 68 has a semicircular first bearing 70 in sliding contact with half of a periphery of the crankpin 65. Integrally provided at opposite ends of the sub-rod 68 are a pair of bifurcated portions 71, 72 sandwiching the other end of the connecting rod 64 and the one end of the control rod 69, respectively. The other half of the periphery of the crankpin 65 is in sliding contact with a semicircular second bearing 74 of a crank cap 73. The crank cap 73 is secured to the sub-rod 68.

The other end of the connecting rod 64 is swingably connected, via a connecting rod pin 75, to one end of the sub-rod 68, that is, the one end of the first arm 66. Opposite ends of the connecting rod pin 75, which are press-fitted in the other end of the connecting rod 64, are swingably fitted in the bifurcated portion 71 on the side corresponding to the one end of the sub-rod 68.

The one end of the control rod 69 is swingably connected, via a cylindrical sub-rod pin 76, to the other end of the sub-rod 68, that is, the other end of the second arm 67. The sub-rod pin 76, in a relative manner, swingably runs through the one end of the control rod 69, which is inserted into the bifurcated portion 72 on the side corresponding to the other end of the sub-rod 68. Opposite ends of the sub-rod pin 76 are a clearance fit with the bifurcated portion 72 on the side corresponding to the other end of the sub-rod 68. Attached to the bifurcated portion 72 on the side corresponding to the other end of the sub-rod 68 are a pair of clips 77 which abut against opposite ends of the sub-rod pin 76 in order to prevent the sub-rod pin 76 from falling out of the bifurcated portion 72.

Furthermore, the crank cap 73 is secured to the bifurcated portions 71, 72 by two pairs of bolts 78 disposed on opposite sides of the crankshaft 72. The connecting rod pin 75 and the sub-rod pin 76 are disposed on lines extending from these bolts 78.

Figure 5:
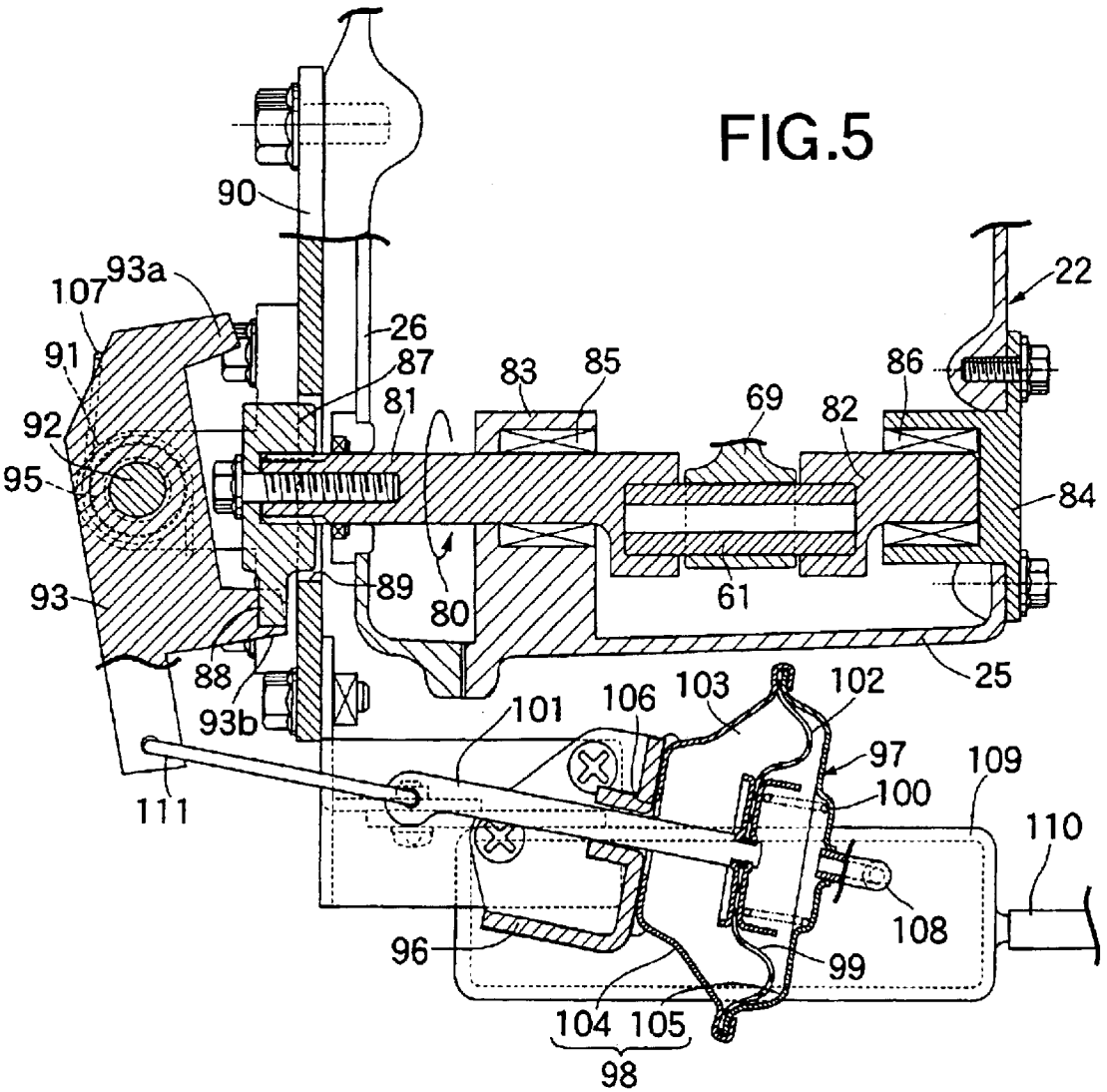
FIG. 5 is a magnified cross-sectional view of the engine taken along line 5—5 in FIG. 1 while the engine is in a light load state.

Referring also to FIG. 5, the cylindrical support shaft 61 is provided in an eccentric position between a pair of coaxially disposed rotating shafts 81, 82 with axes that are parallel to the crankshaft 27. The rotating shaft 81 is supported via a one-way clutch 85 on a support portion 83 integrally provided in an upper part of the case main body 25 of the crankcase 22. The rotating shaft 82 is supported via a one-way clutch 86 on a support member 84 mounted on the case main body 25.

A load in a direction in which the control rod 69 is compressed and a load in a direction in which the control rod 69 is pulled, alternately act on the control rod 69 connected at the other end to the support shaft 61, according to the running cycle of the engine. Since the support shaft 61 is provided in the eccentric position between the rotating shafts 81, 82, the rotating shafts 81, 82 also alternately receive from the control rod 69 the rotational force in one direction and the rotational force in the other direction. That is, since the one-way clutches 85, 86 are disposed between the rotating shafts 81, 82 and the support portion 83 and the support member 84, the rotating shafts 81, 82 can only rotate in a direction indicated by the arrow 80.

A latching member 87 is fixed to one end of the rotating shaft 81 which runs rotatably through the side cover 26 of the crankcase 22 and projects outward. The latching member 87 is formed in a disc shape having, in one location in a circumferential direction, a restricting projection 88 projecting outward in the radial direction.

Secured on the outer face of the side cover 26 are a support plate 90 and a pair of brackets 91 projecting outward from the support plate 90. The support plate 90 has an opening 89 into which a part of the latching member 87 is inserted. Fixedly supported by the two brackets 91 are opposite ends of a shaft member 92 disposed in a position to the outside of the latching member 87, with the axis of the shaft member 92 perpendicular to the axis of the rotating shaft 81.

Rockably supported on the shaft member 92 is a rocker member 93 that includes a pair of engagement portions 93*a*, 93*b* positioned such that their phases are displaced from each other by, for example, 167 degrees. The engagement portions 93*a*, 93*b* are capable of engaging the restricting projection 88 of the latching member 87. In order to establish the position of the rocker member 93 along the axis of the shaft member 92, cylindrical spacers 94, 95 surrounding the shaft member 92 are disposed between two brackets 91 and the rocker member 93. Provided between the rocker member 93 and the support plate 90 is a return spring 107 that biases the rocker member 93 to swing in a direction in which the engagement portion 93*a*, among the two engagement portions 93*a*, 93*b*, engages the restricting projection 88.

A diaphragm-type actuator 97 is connected to the rocker member 93. The actuator 97 includes a casing 98, a diaphragm 99, a spring 100, and an operating rod 101 connected to a central part of the diaphragm 99. The casing 98 is mounted on a bracket 96 provided on the support plate 90. The diaphragm 99 is supported by the casing 98 to partition the interior of the casing 98 into a negative pressure chamber 102 and an atmospheric pressure chamber 103. The spring 100 is provided between the casing 98 and the diaphragm 99 in a compressed state to exert a spring force in a direction in which the volume of the negative pressure chamber 102 increases.

The casing 98 is formed from a bowl-shaped first case half 104 and a bowl-shaped second case half 105 which are caulking-bonded together, the first case half 104 being mounted on the bracket 96. The peripheral edge of the diaphragm 99 is sandwiched between the open ends of the two case halves 104, 105. The negative pressure chamber 102 houses the spring 100 and is formed between the diaphragm 99 and the second case half 105.

The atmospheric pressure chamber 103 is formed between the diaphragm 99 and the first case half 104. One end of the operating rod 101 penetrates a through hole 106, which is provided in a central part of the second case half 104, and projects into the atmospheric pressure chamber 103, and is connected to the central part of the diaphragm 99 so that the atmospheric pressure chamber 103 communicates with the outside via a gap between the inner periphery of the through hole 106 and the outer periphery of the operating rod 101.

A pipe 108 communicating with the negative pressure chamber 102 is connected to the second case half 105 of the casing 98. A surge tank 109 is supported by the bracket 96 in a position adjacent to the actuator 97. The pipe 108 is connected to the surge tank 109. A pipe 110 communicating with the surge tank 109 is connected to the downstream end of the intake passage 46 of the carburetor 34. That is, the intake negative pressure of the intake passage 46 is introduced into the negative pressure chamber 102 of the actuator 97, so that the surge tank 109 functions so as to attenuate pulsations of the intake negative pressure.

The other end of the operating rod 101 of the actuator 97 is connected to the rocker member 93 via a connecting rod 111. When the engine is running in a light load state and the negative pressure of the negative pressure chamber 102 is high, as shown in FIG. 5, the diaphragm 99 flexes so as to decrease the volume of the negative pressure chamber 102 against the spring forces of the return spring 107 and the spring 100, so that the operating rod 101 is contracted. In this state, the rocker member 93 swings to a position where the engagement portion 93*b*, among the two engagement portions 93*a*, 93*b*, engages the restricting projection 88 of the latching member 87.

Figure 6:
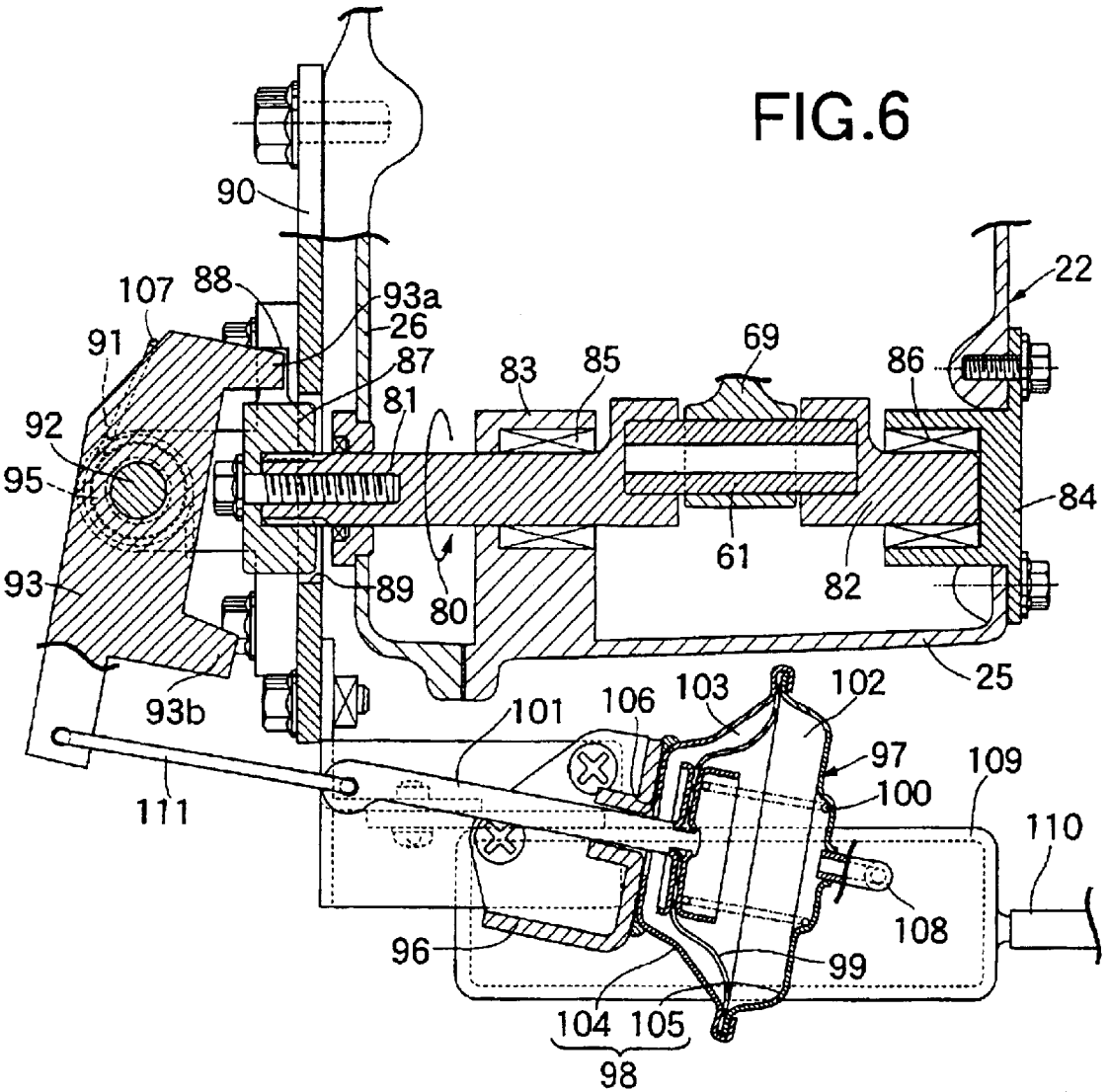
FIG. 6 is a cross-sectional view corresponding to FIG. 5 but while the engine is in a heavy load state.
Figure 7:
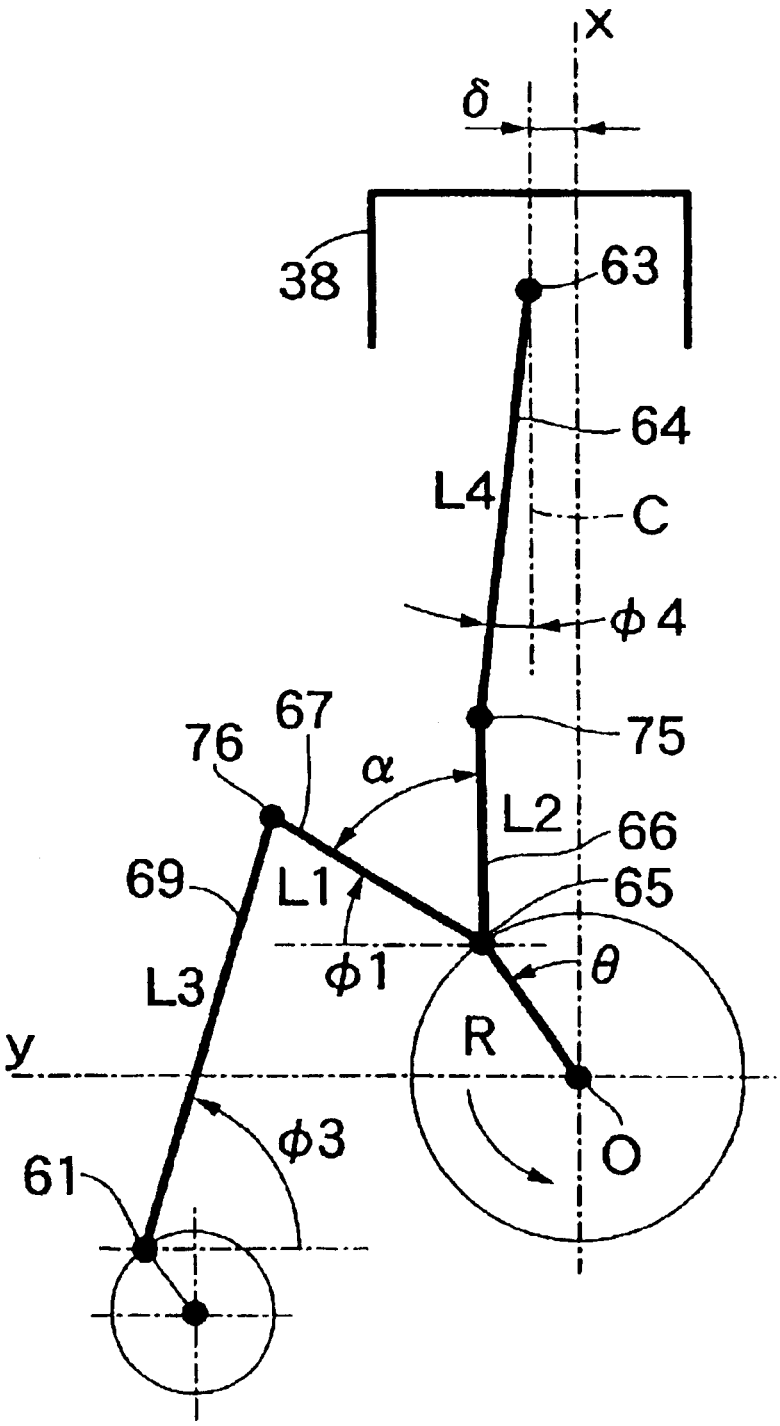
FIG. 7 is a schematic diagram showing the layout of a link mechanism.

When the engine is running in a heavy load state and the negative pressure of the negative pressure chamber 102 becomes low, as shown in FIG. 6, the diaphragm 99 is flexed by the spring forces of the return spring 107 and the spring 100 to increase the volume of the negative pressure chamber 102 and extend the operating rod 101. The rocker member 93 thereby swings to a position where the engagement portion 93*a*, among the two engagement portions 93*a*, 93*b*, engages the restricting projection 88 of the latching member 87.

Swinging the rocker member 93 in this manner can restrict the rotation of the rotating shafts 81, 82 to which the rotational force is applied, in one direction while the engine is running, at positions where either one of the engagement portions 93*a*, 93*b* is engaged with the restricting projection 88 of the latching member 87, which rotates with the rotating shaft 81. Since the rotating shafts 81, 82 stop rotating in the two positions where the phases are displaced from each other by, for example, 167 degrees, the support shaft 61 positioned eccentrically relative to the axes of the rotating shafts 81, 82, that is, the other end of the control rod 69 shifts between two out-of-phase positions in the plane perpendicular to the axis of the crankshaft 27, thereby varying the compression ratio of the engine.

Moreover, the link mechanism 62 is arranged so that not only is the compression ratio changed, but so is the stroke of the piston 38. The dimensional relationships of the link mechanism 62 is now explained by reference to FIG. 7.

An xy plane is defined by an x-axis that passes through the axis of the crankshaft 27 along the cylinder axis C, and a y-axis that is perpendicular to the x-axis and passes through the axis of the crankshaft 27. The length of the connecting rod 64 is denoted by L4. The length of the first arm 66 is denoted by L2. The length of the second arm 67 is denoted by L1. The length of the control rod 69 is denoted by L3. The angle formed by the connecting rod 64 with the x-axis is denoted by $\phi 4$. The angle formed by the first and second arms 66, 67 is denoted by $\alpha$. The angle formed by the second arm 67 with the y-axis is denoted by $\phi 1$. The angle formed by the control rod 69 with the y-axis is denoted by $\phi 3$. The angle formed by the straight line between the axis of the crankshaft 27 and the crankpin 65 with the x-axis is denoted by $\theta$. The length between the axis of the crankshaft 27 and the crankpin 65 is denoted by R. The xy coordinates of the support shaft 61 are denoted by Xpiv and Ypiv. The rotational angular speed of the crankshaft is denoted by $\omega$. The offset in the y-axis direction of the cylinder axis C from the axis of the crankshaft 27 is denoted by $\delta$. The height X of the piston 63 is:

$$X=L4\cdot\cos\phi 4+L2\cdot\sin(\alpha+\phi 1)+R\cdot\cos\theta \quad (1)$$

In the equation, $\phi 4=\arcsin\{L2\cdot\cos(\alpha+\phi 1)+R\cdot\sin\theta-\delta\}/L4$ $\phi 1=\arcsin\{(L3^2-L1^2-C^2-D^2)/2\cdot L1\cdot\sqrt{(C^2+D^2)}\}-\arctan(C/D)$ $C=Ypiv-R\sin\theta$ $D=Xpiv-R\cos\theta$ Here, the speed of the piston pin 63 in the x-axis direction is obtained by differentiating equation (1) above and is expressed by equation (2) below.

$$dX/dt=-L4\cdot\sin\phi 4\cdot(d\phi 4/dt)+L2\cdot\cos(\alpha+\phi 1)\cdot(d\phi 1/dt)-R\cdot\omega\cdot\sin\theta \quad (2)$$

In the equation, $$d\phi 4/dt=\omega\cdot\{-L2\cdot\sin(\alpha+\phi 1)\cdot R\cdot\cos(\theta-\phi 3)/L1\cdot\sin(\phi 1+\phi 3)+R\cdot\cos\theta\}/(L4\cdot\cos\phi 4)$$

$\phi 3=\arcsin\{(R\cdot\cos\theta-Xpiv+L1\cdot\sin\phi 1)/L3\}$ $d\phi 1/dt=\omega\cdot R\cdot\cos(\theta-\phi 3)/\{L1\cdot\sin(\phi 1+\phi 3)\}$ The equation $dX/dt=0$ in equation (2) above has two solutions for $\theta$ in the range of $0<\theta<2\pi$. When making the two solutions correspond to the action of a 4-cycle engine so that when the piston pin 63 is at top dead center, the crank angle is $\theta pivtdc$ and when the piston pin 63 is at bottom dead center, the crank angle is $\theta pivbdc$, the position of the piston pin 63 for each of the crank angles $\theta pivtdc$, $\theta pivbdc$ is obtained by putting $\theta pivtdc$, $\theta pivbdc$ in equation (1) above. In this case, the top dead center position of the piston pin 63 in the x-axis direction is denoted by Xpivtdc and the bottom dead center position of the piston pin 63 in the x-axis direction is denoted by Xpivbdc. The stroke Spiv of the piston pin 63 is obtained from Xpivtdc−Xpivbdc.

Here, the displacement Vhpiv is given by $\{Vhpiv=Spiv\cdot(B^2/4)\cdot\pi\}$, where B denotes the inner diameter of the cylinder bore 39. The compression ratio $\epsilon piv$ is given by $\{\epsilon piv=1+(Vhpiv/Vapiv)\}$, where Vapiv denotes the volume of the combustion chamber at top dead center.

In this way, the displacement Vhpiv0 and compression ratio $\epsilon piv0$ when the support shaft 61 is in a first position and the displacement Vhpiv1 and compression ratio $\epsilon piv1$ when the support shaft 61 moves from the first position to a second position are determined. Furthermore, the length L1 of the second arm 67, the length L2 of the first arm 66, the length L3 of the control rod 69, the length L4 of the connecting rod 64, the offset $\delta$ in the y-axis direction of the cylinder axis C from the axis of the crankshaft 27, and the angle $\alpha$ formed by the first and second arms 66, 67 are set so that the relationships below are satisfied.

When $\epsilon piv1<\epsilon piv0$, $Vhpiv1>Vhpiv0$.

When $\epsilon piv1>\epsilon piv0$, $Vhpiv1<Vhpiv0$.

Figure 8:
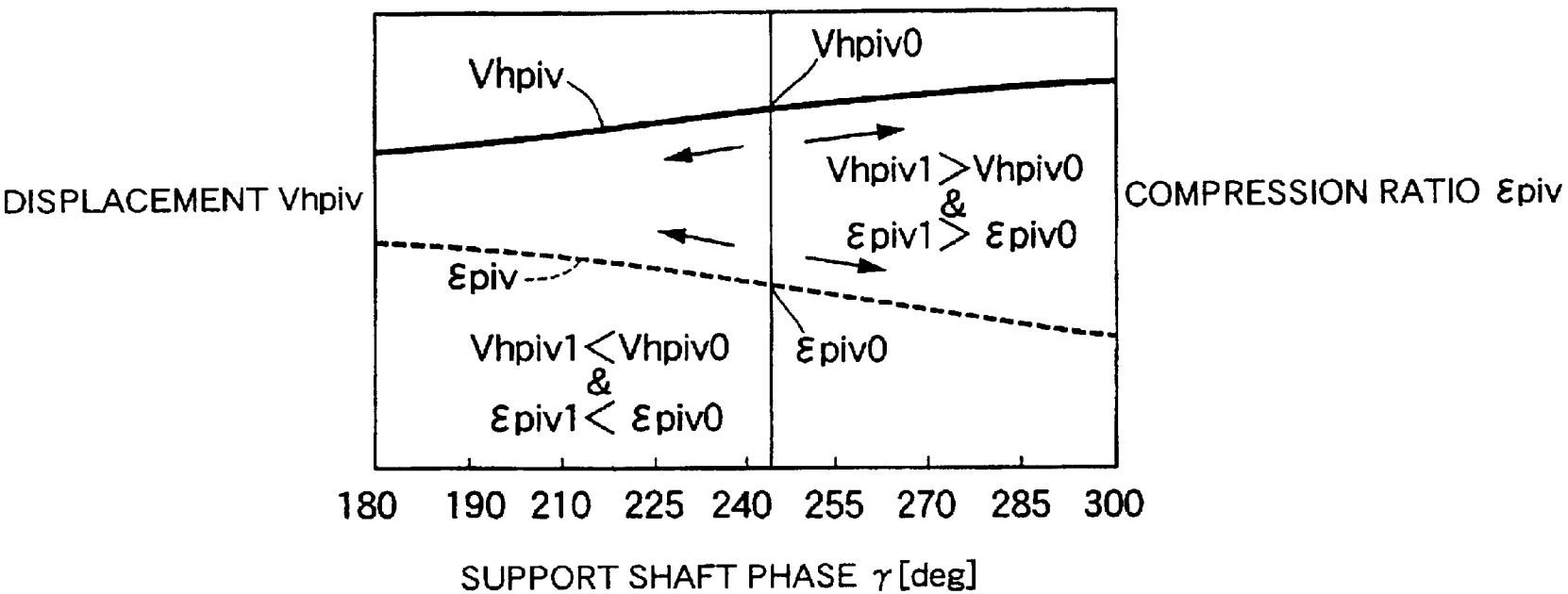
FIG. 8 is a chart illustrating the relationships between the phase of a support shaft, the displacement, and the compression ratio.

Setting the relationships in this way allows the values for the displacement Vhpiv and compression ratio $\epsilon piv$ to change in opposite directions in response to a change in the phase of the support shaft 61, as shown in FIG. 8. When the displacement is large, the engine runs with a low compression ratio. When the displacement is small, the engine runs with a high compression ratio.

Figure 9:
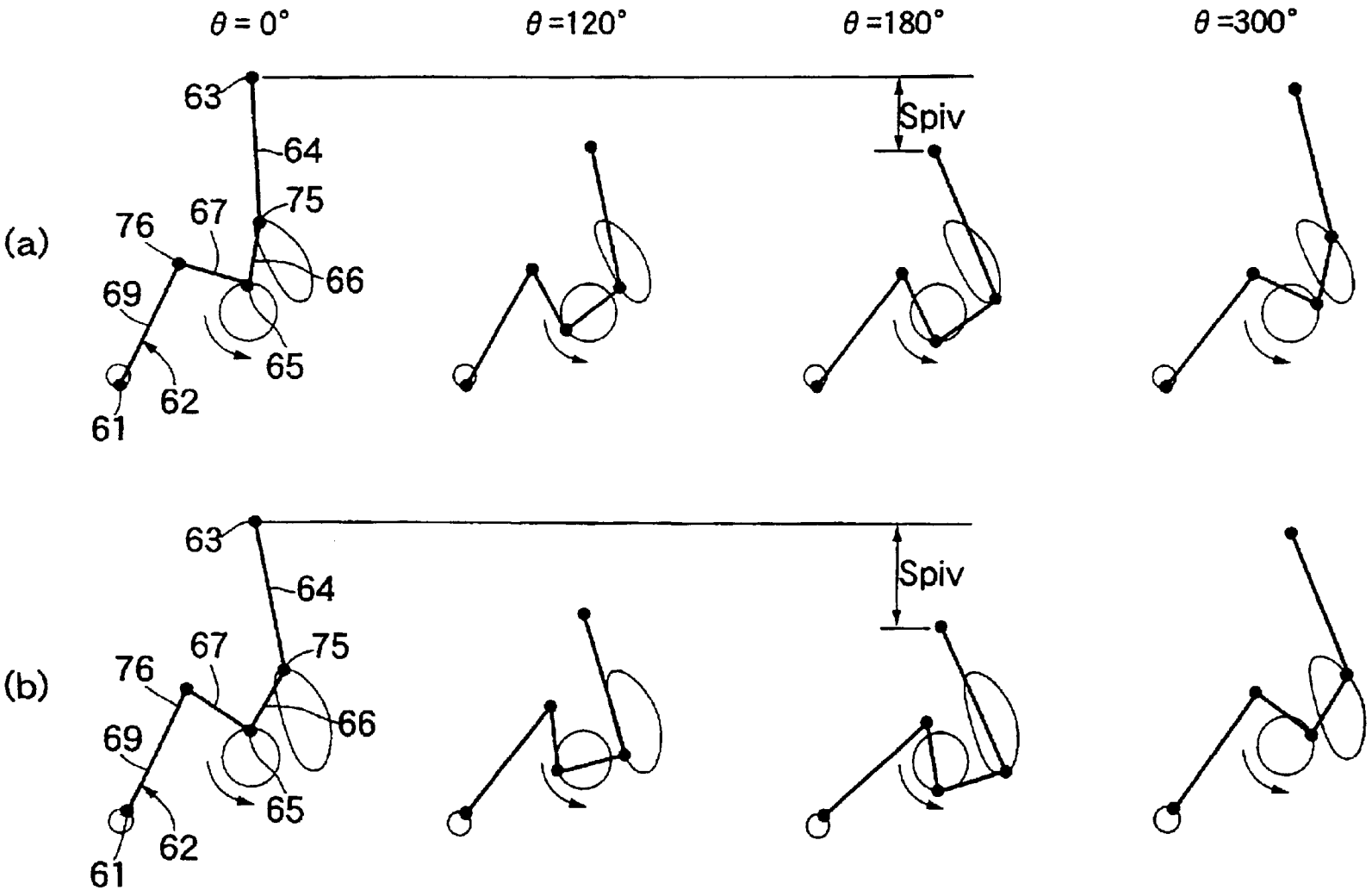
FIGS. 9(A) and 9(B) are schematic diagrams sequentially showing the operational states of the link mechanism.

That is, the link mechanism 62 works as shown in FIG. 9(*a*) when the support shaft 61 is in a position corresponding to a light load state of the engine. Moreover, the link mechanism 62 works as shown in FIG. 9(*b*) when the support shaft 61 is in a position corresponding to a heavy load state of the engine. The stroke Spiv of the piston pin 63 in the heavy load state of the engine is larger than the stroke Spiv of the piston pin 63 in the light load state of the engine. Moreover, since the compression ratio in the light load state of the engine is higher than the compression ratio in the heavy load state, the engine runs with a small displacement and a high compression ratio when the load is light and with a large displacement and a low compression ratio when the load is heavy.

The operation of the first embodiment is now explained. The link mechanism 62 includes the connecting rod 64 having one end connected to the piston 38 via the piston pin 63, the first arm 66 having one end swingably connected to the other end of the connecting rod 64 and the other end connected to the crankshaft 27 via the crankpin 65, the second arm 67 having one end connected integrally to the other end of the first arm 66 thereby cooperatively forming the sub-rod 68, and the control rod 69 having one end connected swingably to the other end of the second arm 67. The length L1 of the second arm 67, the length L2 of the first arm 66, the length L3 of the control rod 69, the length L4 of the connecting rod 64, the offset $\delta$ in the y-axis direction of the cylinder axis C from the axis of the crankshaft 27, and the angle $\alpha$ formed by the first and second arms 66, 67 are appropriately set while allowing the compression ratio to vary by changing the position of the support shaft 61, which supports the other end of the control rod 69, according to the running conditions of the engine. The stroke of the piston 63 thus becomes variable, and the engine runs with a low compression ratio when the displacement is large and with a high compression ratio when the displacement is small.

Figure 10:
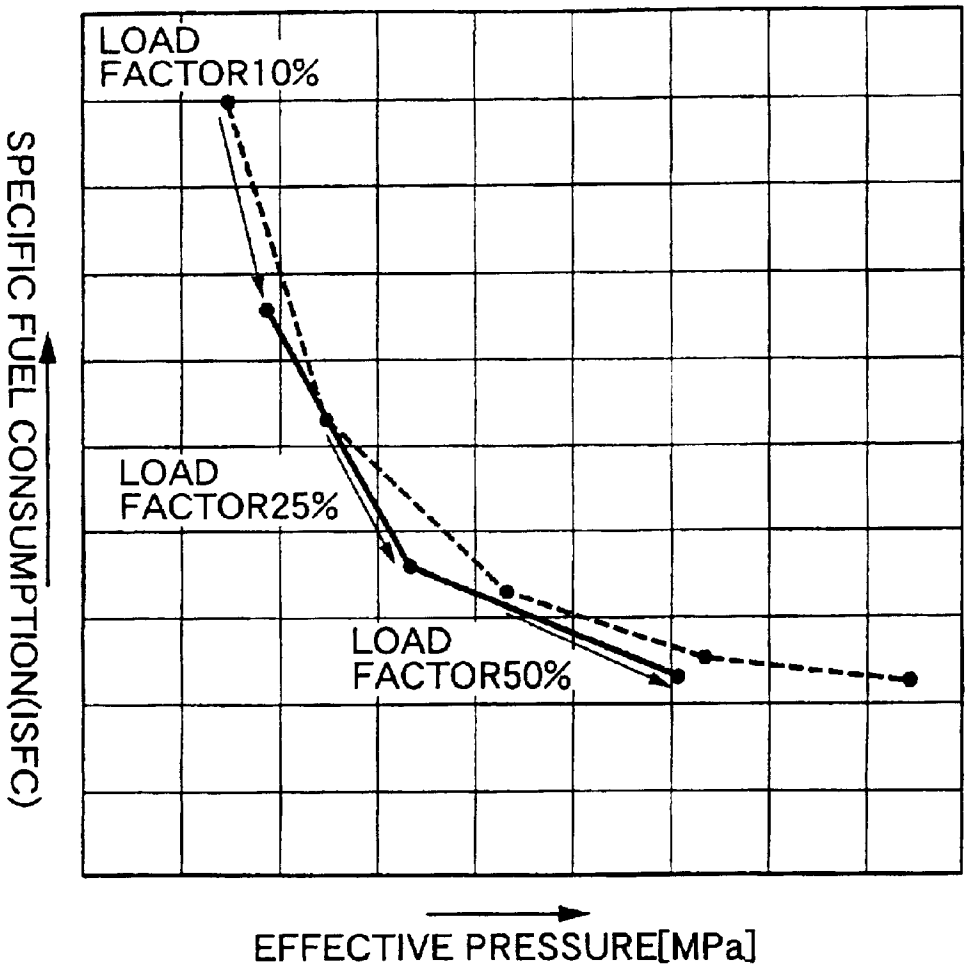
FIG. 10 is a chart illustrating the relationship between the average effective pressure and specific fuel consumption.

Running with a small displacement and a high compression ratio when the load of the engine is light can achieve a high thermal efficiency and decrease the indicated specific fuel consumption, as shown by the solid line in FIG. 10, in comparison with the conventional arrangement shown by the broken line therein, thereby reducing the fuel consumption. Running with a large displacement and a low compression ratio when the load is heavy prevents the combustion load and the cylinder internal pressure from increasing excessively, which avoids problems involving noise and strength.

The first and second arms 66, 67 form the sub-rod 68 in cooperation with each other. The sub-rod 68 has a semicircular first bearing 70 that is in sliding contact with half of the periphery of the crankpin 65. The connecting rod 64 is swingably connected to one end of the sub-rod 68. One end of the control rod 69 is swingably connected to the other end of the sub-rod 68. The crank cap 73 has the semicircular second bearing 74, which is in sliding contact with the other half of the periphery of the crankpin 65, and is secured to the pair of bifurcated portions 71, 72 integrally provided on the sub-rod 68 so as to sandwich the other end of the connecting rod 64 and the one end of the control rod 69, respectively. As a result, the rigidity with which the sub-rod 68 is mounted on the crank pin 65 is increased.

Furthermore, opposite ends of the connecting rod pin 75 that is press-fitted in the other end of the connecting rod 64 are swingably fitted in the bifurcated portion 71. Opposite ends of the sub-rod pin 76 that relatively swingably runs through the one end of the control rod 69 are clearance-fit with the other bifurcated portion 72. Therefore, after separately installing in the engine the control rod 69, and the piston 38 to the sub-rod 68, the sub-rod 68 and the control rod 69 are connected, thereby facilitating the assembly operation while enhancing the precision of assembly, and as a result an increase in the dimensions of the engine can be avoided.

Moreover, since the connecting rod pin 75 and the sub-rod pin 76 are disposed on lines extending from bolts 78 that secure the crank cap 73 to the sub-rod 68, the sub-rod 68 and the crank cap 73 are rendered compact, thus reducing the weight of the sub-rod 68 and the crank cap 73 to suppress the power loss.

Furthermore, the pair of rotating shafts 81, 82 are supported via the one-way clutches 85, 86 on the support portion 83 integrally provided on the case main body 25 of the crankcase 22 of the engine main body 21 and on the support member 84 mounted on the case main body 25. The support shaft 61 is provided in a relatively eccentric position between the two rotating shafts 81, 82. Moreover, since the support shaft 61 alternately receives a load in a direction in which the control rod 69 is compressed and a load in a direction in which the control rod 69 is pulled according to the running cycle of the engine, the rotating shafts 81, 82 alternately receive a load to rotate the rotating shafts 81, 82 in one direction and a load to rotate the rotating shafts 81, 82 in the other direction. However, the one-way clutches 85, 86 function so that the rotating shafts 81, 82 can only rotate in one direction.

Moreover, the latching member 87 having the restricting projection 88 at one location in the circumferential direction is fixed to one end of the rotating shaft 81 projecting out of the side cover 26 of the engine main body 21. The rocker member 93 having the pair of engagement portions 93*a*, 93*b* that have phases displaced from each other by, for example, 167 degrees and that can engage with the restricting projection 88 of the latching member 87, is rockably supported on the shaft member 92 fixed to the engine main body 21 so that the axis of the shaft member 92 is perpendicular to the rotating shaft 81. The rocker member 93 is spring-biased by the return spring 107 in a direction in which one of the two engagement portions 93*a*, 93*b* engages the restricting projection 88.

The engine main body 21 supports the diaphragm-type actuator 97, which includes the diaphragm 99 with opposite sides that face the negative pressure chamber 102, that communicates with the intake passage 46 of the carburetor 34, and the atmospheric pressure chamber 103, that opens to the outside air. The peripheral edge of the diaphragm 99 is sandwiched by the casing 98. The actuator 97 is connected to the rocker member 93 so that the rocker member 93 swings in the direction opposite to the spring biasing direction in response to an increase in the negative pressure of the negative pressure chamber 102.

That is, making the actuator 97 operate according to the load of the engine maintains the rotating shafts 81, 82, that is, the support shaft 61, at two positions having phases displaced from each other by, for example, 167 degrees. Accordingly, the support shaft 61, that is, the other end of the control rod 69, shifts between a position corresponding to a high compression ratio and a position corresponding to a low compression ratio. Moreover, the use of the diaphragm-type actuator 97 enables the control rod 69 to change position with minimal power loss of the engine, while avoiding an increase in the dimensions of the engine and preventing the structural arrangement from becoming complicated.

Figure 11:
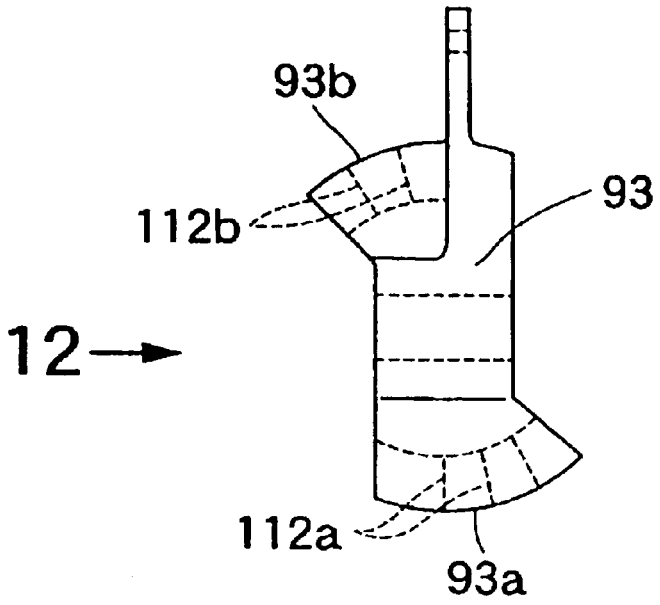
FIG. 11 is a front view of a latching member according to a second embodiment of the present invention.
Figure 12:
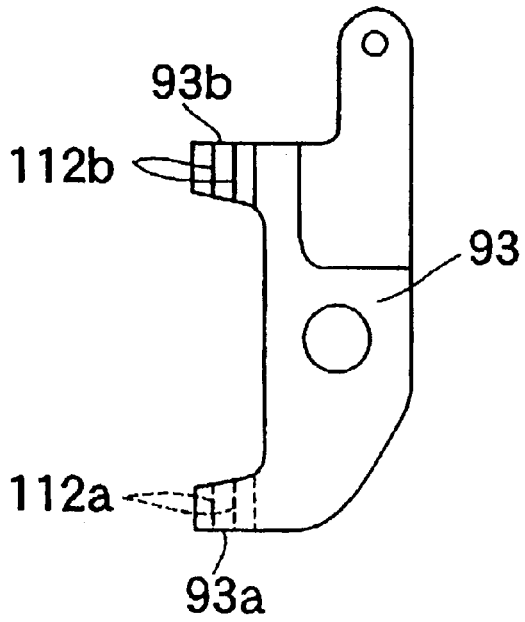
FIG. 12 is a view of the latching member taken from arrow 12 in FIG. 11.

The second embodiment of the present invention is now explained by reference to FIGS. 11 and 12. A plurality of steps 112*a*, 112*b* are formed on both engagement portions 93*a*, 93*b* of a rocker member 93. The plurality of steps 112*a*, 112*b* are arranged in the circumferential direction of the latching member 87 (see FIGS. 5 and 6) so that each step 112*a*, 112*b* sequentially engages the restricting projection 88 (see FIGS. 5 and 6) of the latching member 87 in response to swinging of the latching member 87.

In accordance with the second embodiment, engaging each step 112*a*, 112*b* with the restricting projection 88 allows the position of the latching member 87 to change stepwise in the circumferential direction, thereby making the compression ratio vary with finer or more accurate differentiation.

Figure 13:
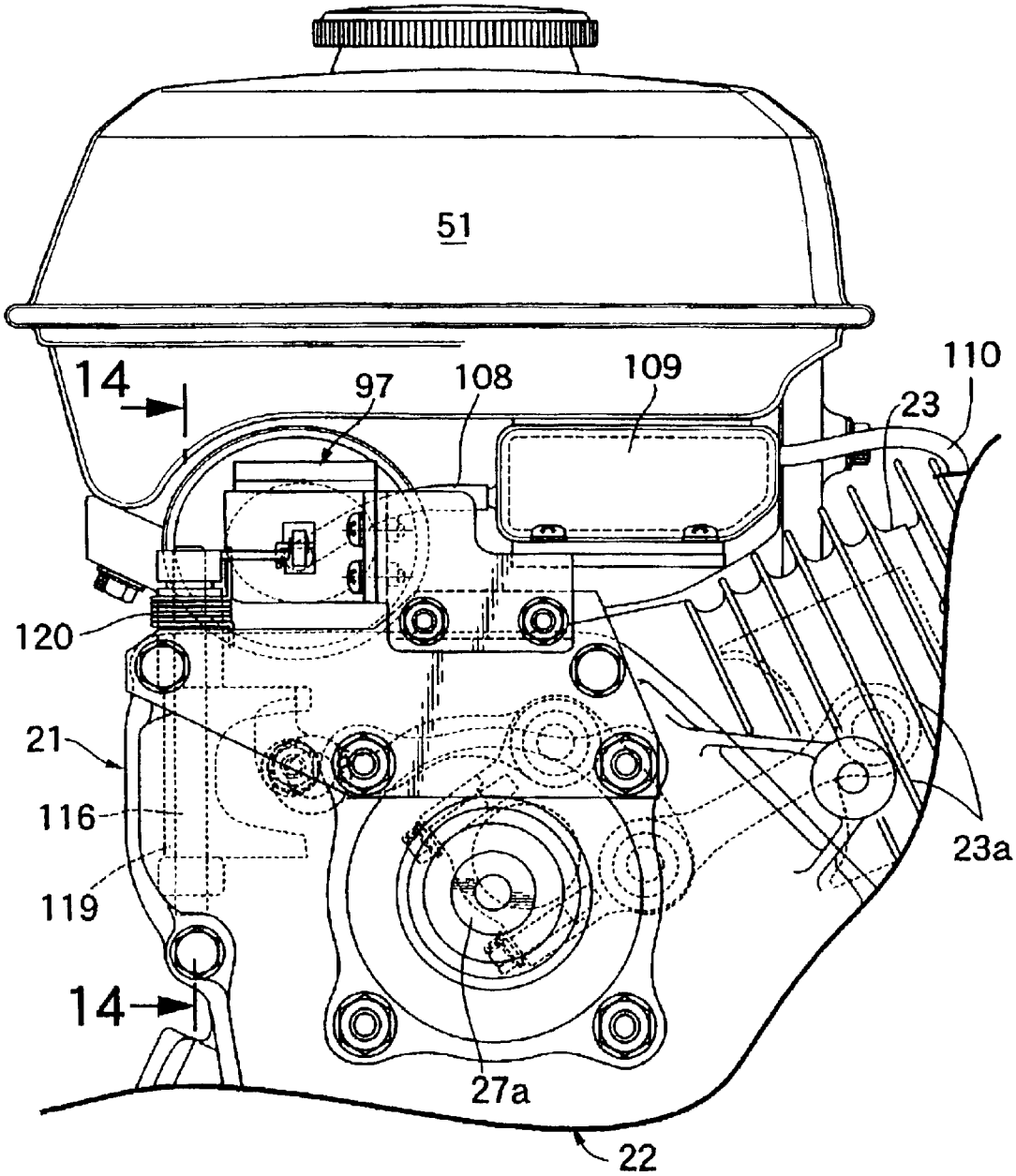
FIG. 13 is a front view of an essential part of an engine according to a third embodiment of the present invention.
Figure 14:
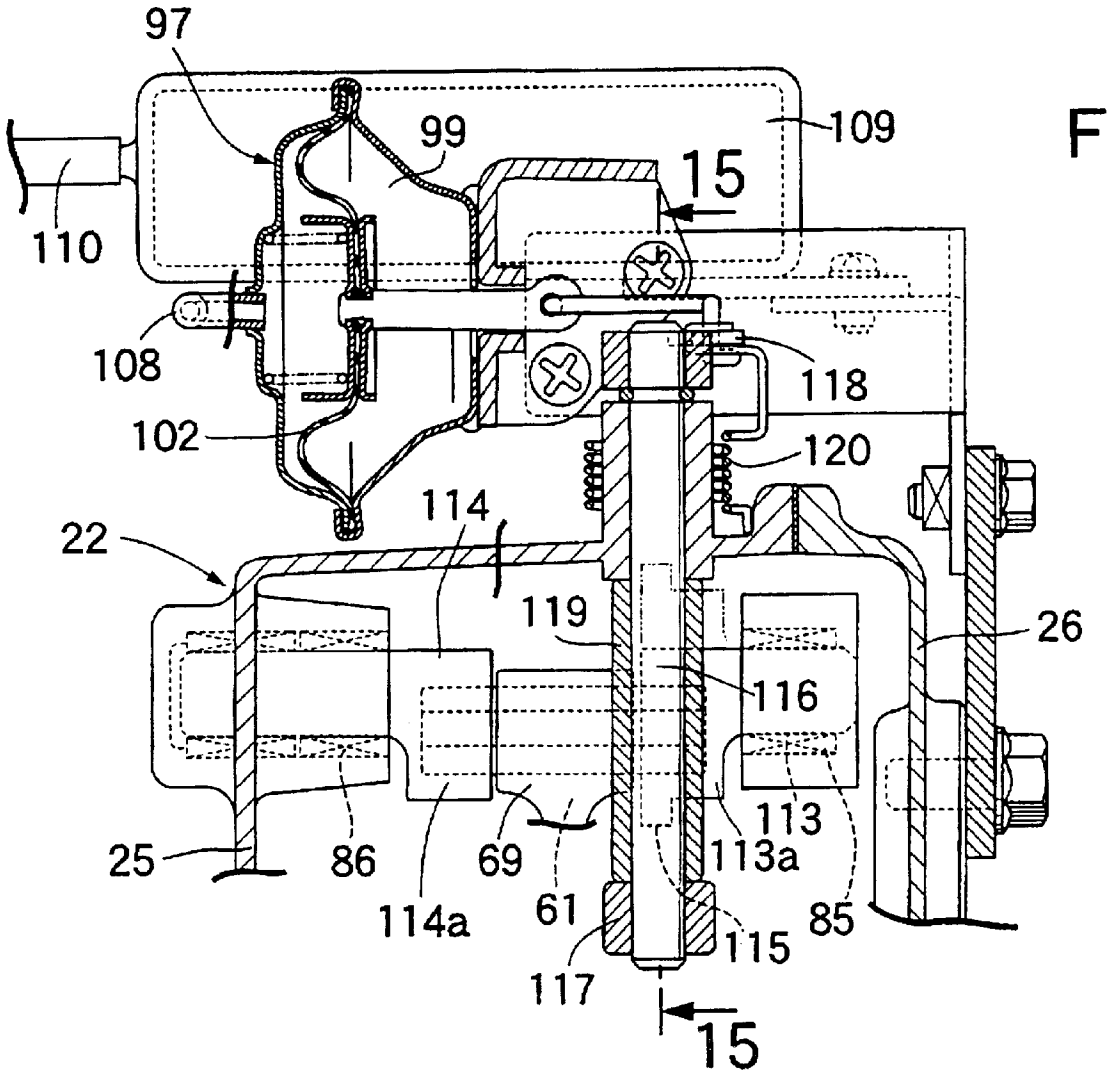
FIG. 14 is a cross-sectional view of the engine taken along line 14—14 in FIG. 13 while the engine is in a light load state.

The third embodiment of the present invention is now explained by reference to FIGS. 13 to 18. Referring firstly to FIGS. 13 and 14, the support shaft 61 is swingably connected to the other end of the control rod 69. Opposite ends of the support shaft 61 are provided between eccentric shaft portions 113*a*, 114*a* of a pair of coaxially disposed rotating shafts 113, 114 with their axes parallel to the crankshaft 27. The rotating shafts 113, 114 are swingably supported in the crankcase 22 via the one-way clutches 85, 86.

A restricting projection 115 is integrally provided at one location in the circumferential direction of the eccentric shaft portion 113*a* of the rotating shaft 113. The restricting projection 115 projects outward in the radial direction.

A shaft member 116 perpendicular to the axes of the rotating shafts 113, 114 runs swingably through the case main body 25 of the crankcase 22 and projects into the interior of the crankcase 22. One end of the shaft member 116 is swingably supported by a support part 117 provided in the crankcase 22.

Fixed to the other end of the shaft member 116 projecting out of the crankcase 22 is a lever 118 to which the diaphragm type actuator 97 is connected.

A rocker member 119 surrounding the shaft member 116 is fixed to the shaft member 116 between the support part 117 and the inner surface of a side wall of the crankcase 22. Provided on the rocker member 119 are a pair of engagement portions 119*a*, 119*b* that engage the restricting projection 115 and have phases displaced from each other by, for example, 167 degrees. Provided between the rocker member 119 and the crankcase 22 is a return spring 120 that biases the rocker member 119 so that the rocker member 119 swings in a direction in which the engagement portion 119*a* engages the restricting projection 115.

Figure 15:
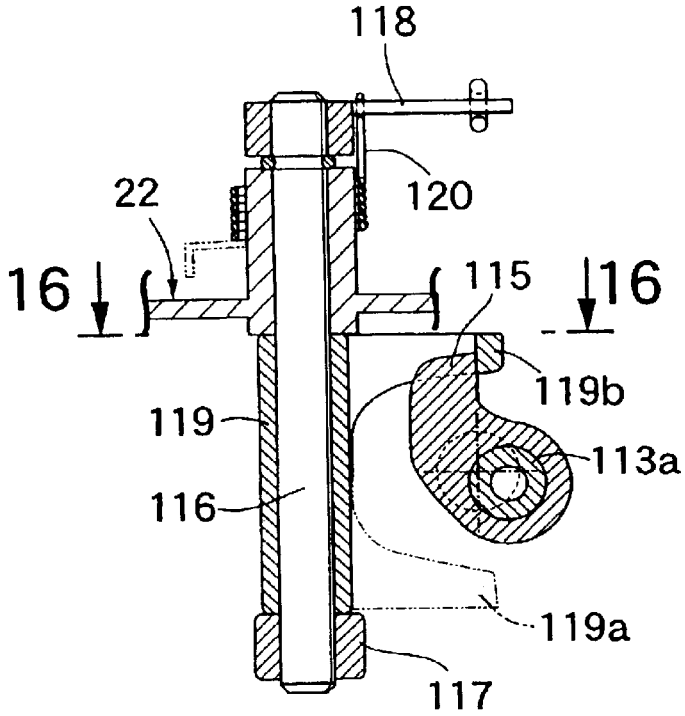
FIG. 15 is a cross-sectional view of the engine taken along line 15—15 in FIG. 14.
Figure 16:
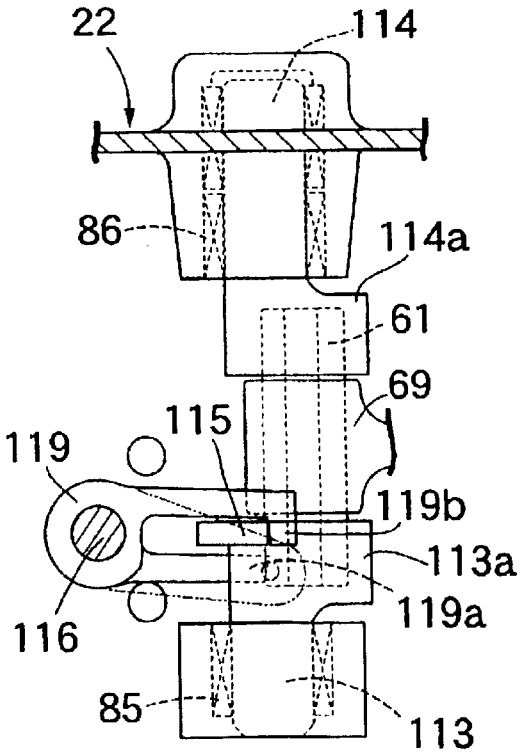
FIG. 16 is a cross-sectional view of the engine taken along line 16—16 in FIG. 15.

The operating rod 101 is contracted when the engine is running in a light load state and the negative pressure of the negative pressure chamber 102 of the actuator 97 is high. The position to which the rocker member 119 swings in this state is a position where the engagement portion 119*b* engages the restricting projection 115, as shown in FIGS. 15 and 16.

Figure 17:
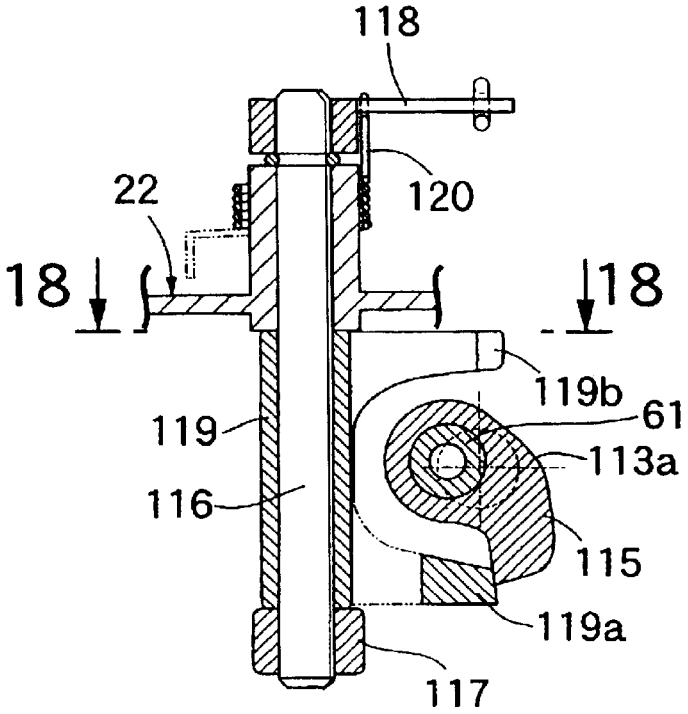
FIG. 17 is a cross-sectional view corresponding to FIG. 15 but while the engine is in a heavy load state.
Figure 18:
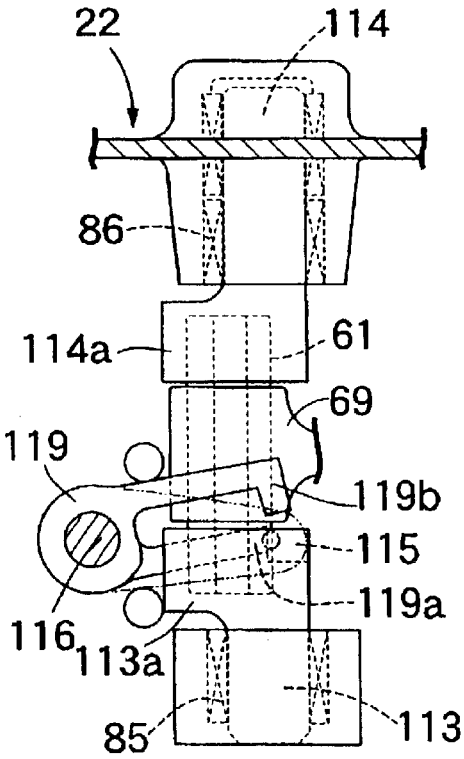
FIG. 18 is a cross-sectional view taken along line 18—18 in FIG. 17.

When the engine is running in a heavy load state and the negative pressure of the negative pressure chamber 102 becomes low, the diaphragm 99 flexes to increase the volume of the negative pressure 102 and extend the operating rod 101. The rocker member 119 is thereby made to swing to a position where the engagement portion 119*a* engages the restricting projection 115, as shown in FIGS. 17 and 18.

Swinging the rocker member 119 in this way makes the support shaft 61, that is, the other end of the control rod 69, shifts between the two positions within a plane perpendicular to the axis of the crankshaft 27, thereby varying the compression ratio and the stroke of the engine.

In accordance with the third embodiment, the same effects as those obtained by the first embodiment are exhibited.

Figure 19:
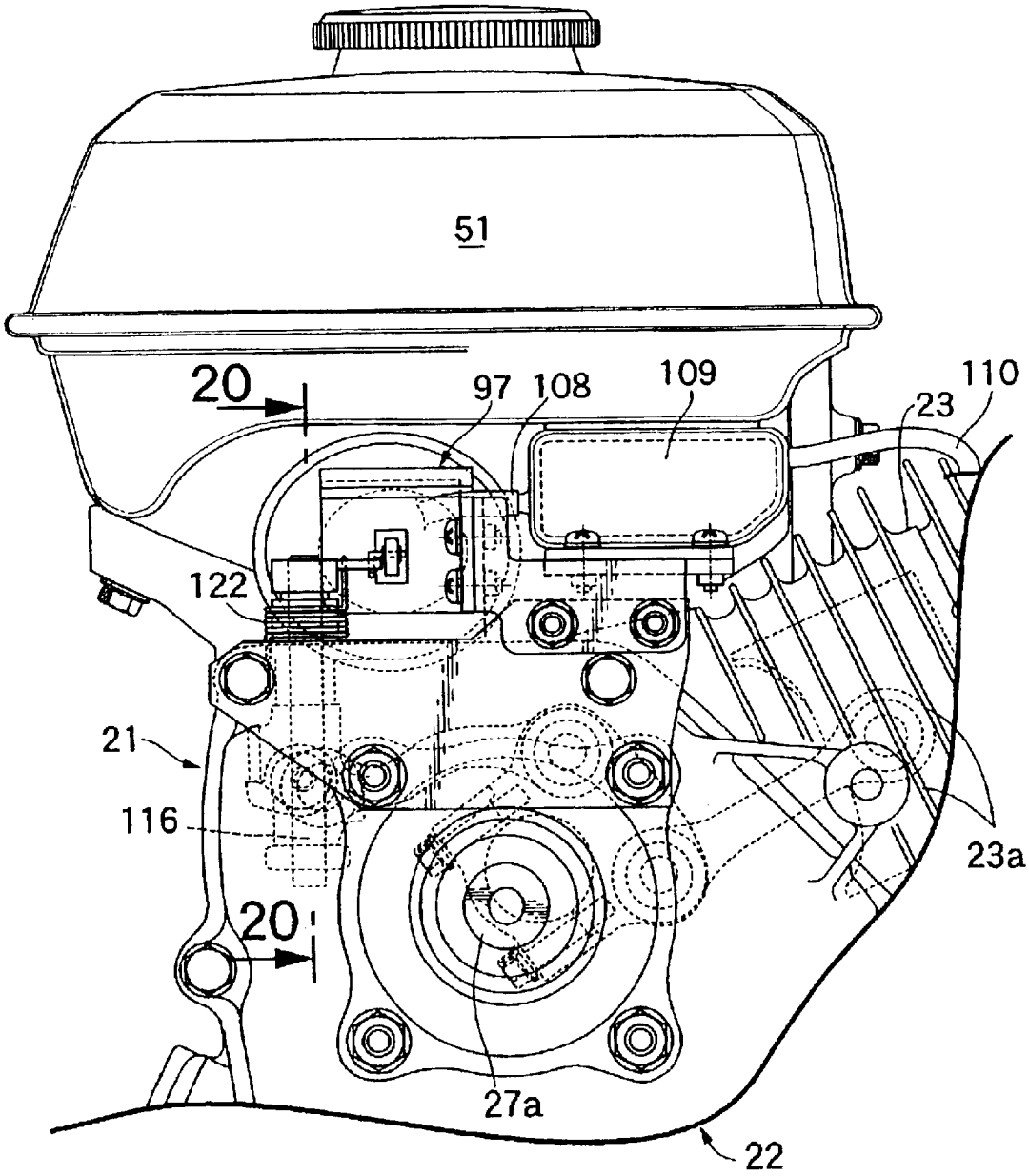
FIG. 19 is a front view of an essential part of an engine according to a fourth embodiment of the present invention.
Figure 20:
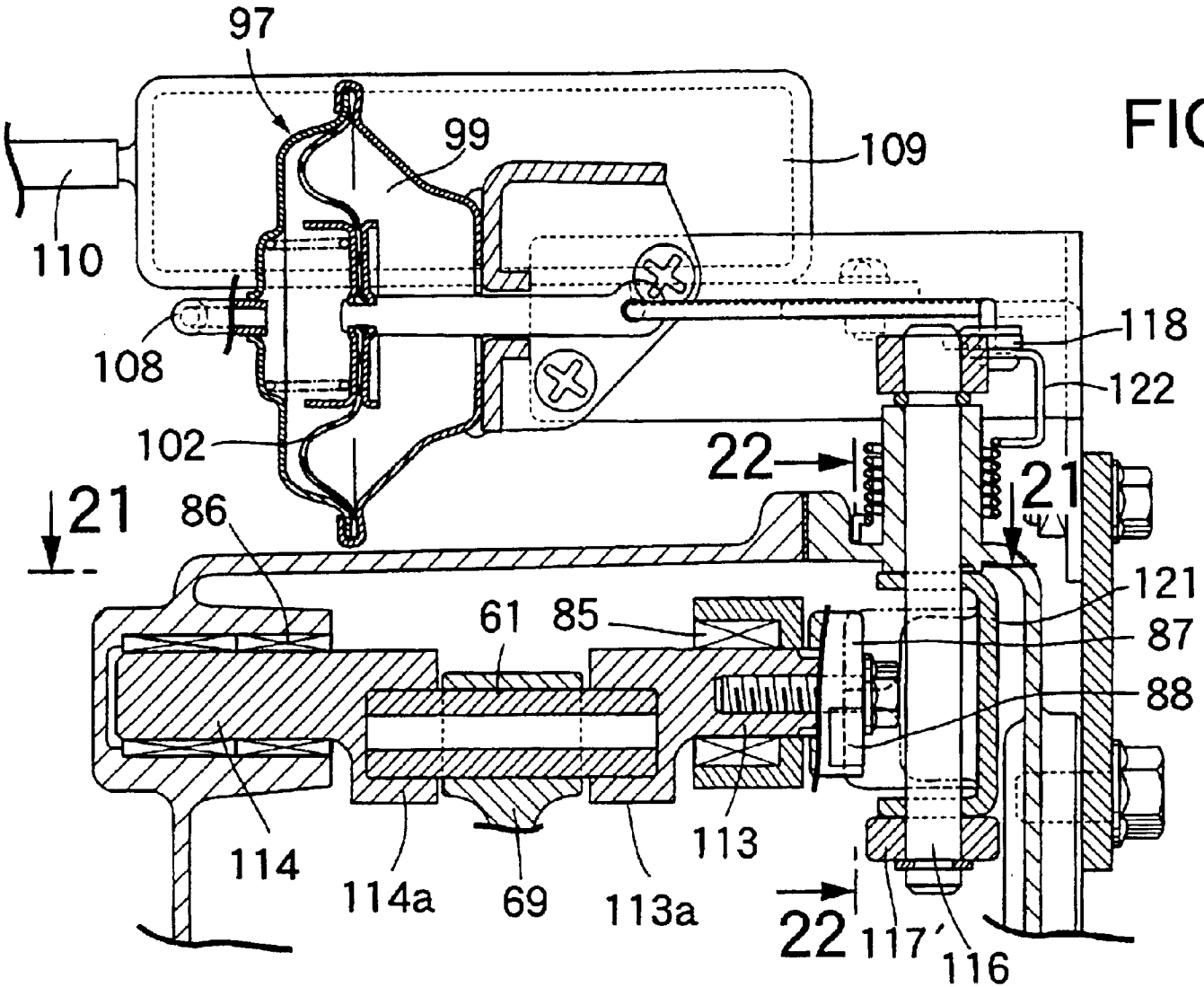
FIG. 20 is a cross-sectional view of the engine taken along line 20—20 in FIG. 19.

The fourth embodiment of the present invention is now explained by reference to FIGS. 19 to 24. Referring firstly to FIGS. 19 and 20, the support shaft 61 is swingably connected to the other end of the control rod 69. Opposite ends of the support shaft 61 are provided between the eccentric shaft portions 113*a*, 114*a* of the coaxially disposed pair of rotating shafts 113, 114 with their axes parallel to the crankshaft 27. The rotating shafts 113, 114 are swingably supported in the crankcase 22 via the one-way clutches 85, 86.

The rotating shaft 113 runs through a support portion 121 provided in the crankcase 22. Fixed to one end of the rotating shaft 113 is the disc-shaped latching member 87 having at one location in the peripheral direction the restricting projection 88 that projects outward in the radial direction.

The shaft member 116, which is perpendicular to the axes of the rotating shafts 113, 114, runs swingably through the side cover 26 of the crankcase 22 and projects into the interior of the crankcase 22. One end of the shaft member 116 is swingably supported by a support portion 117' provided in the crankcase 22.

Fixed to the other end of the shaft member 116 projecting out of the crankcase 22 is the lever 118 to which the diaphragm type actuator 97 is connected.

A rocker member 121 is fixed to the shaft member 116 between the support portion 117' and the inner surface of a side wall of the crankcase 22. Provided on the rocker member 121 are a pair of engagement portions 121*a*, 121*b* that engage the restricting projection 88 and have phases displaced from each other by, for example, 167 degrees. Provided between the rocker member 121 and the crankcase 22 is a return spring 122 that biases the rocker member 121 so that the rocker member 121 swings in a direction in which the engagement portion 121*a* engages the restricting projection 88.

Figure 21:
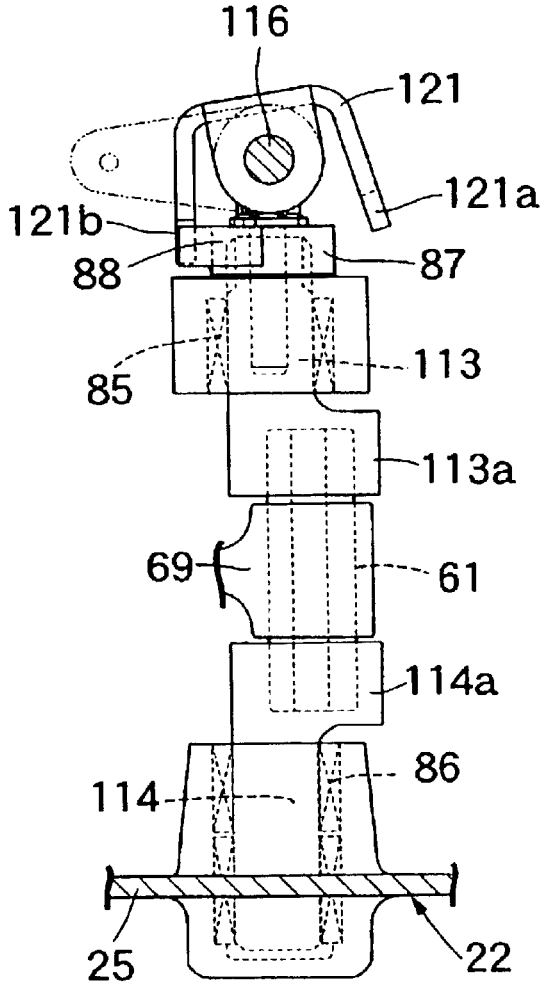
FIG. 21 is a cross-sectional view of the engine taken along line 21—21 in FIG. 20 in a light load state.
Figure 22:
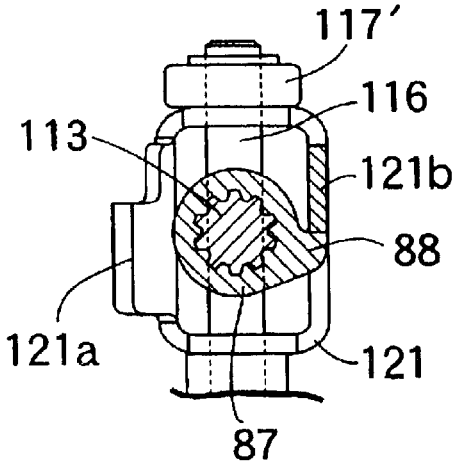
FIG. 22 is a cross-sectional view of the engine taken along line 22—22 in FIG. 20 in a light load state.
Figure 23:
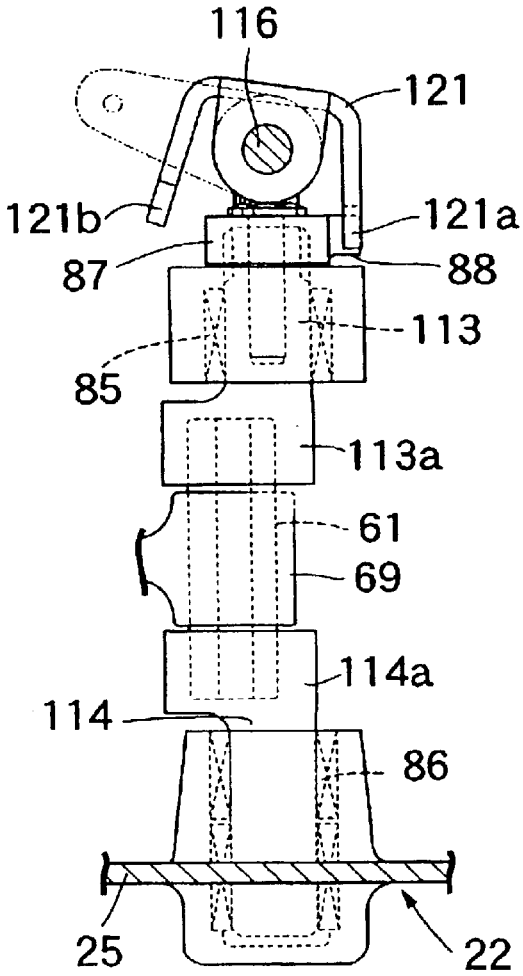
FIG. 23 is a cross-sectional view corresponding to FIG. 21 but while the engine is in a heavy load state.
Figure 24:
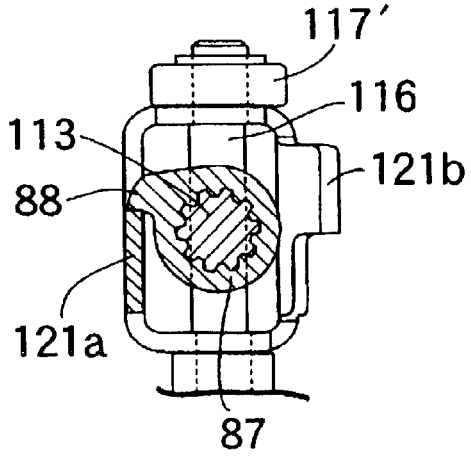
FIG. 24 is a cross-sectional view corresponding to FIG. 22 but while the engine is in a heavy load state.

The operating rod 101 is contracted when the engine is running in a light load state and the negative pressure of the negative pressure chamber 102 of the actuator 97 is high. The position to which the rocker member 121 swings in this state is a position where the engagement portion 121*b* engages the restricting projection 88, as shown in FIGS. 21 and 22.

When the engine is running in a heavy load state and the negative pressure of the negative pressure chamber 102 becomes low, the diaphragm 99 flexes to increase the volume of the negative pressure 102 and extend the operating rod 101. The rocker member 121 is thereby made to swing to a position where the engagement portion 121*a* engages the restricting projection 88.

Swinging the rocker member 121 in this way makes the support shaft 61, that is, the other end of the control rod 69, shift between the two positions within the plane perpendicular to the axis of the crankshaft 27, thereby varying the compression ratio and the stroke of the engine.

In accordance with the fourth embodiment, the same effects as those obtained by the first embodiment are exhibited.

Figure 25:
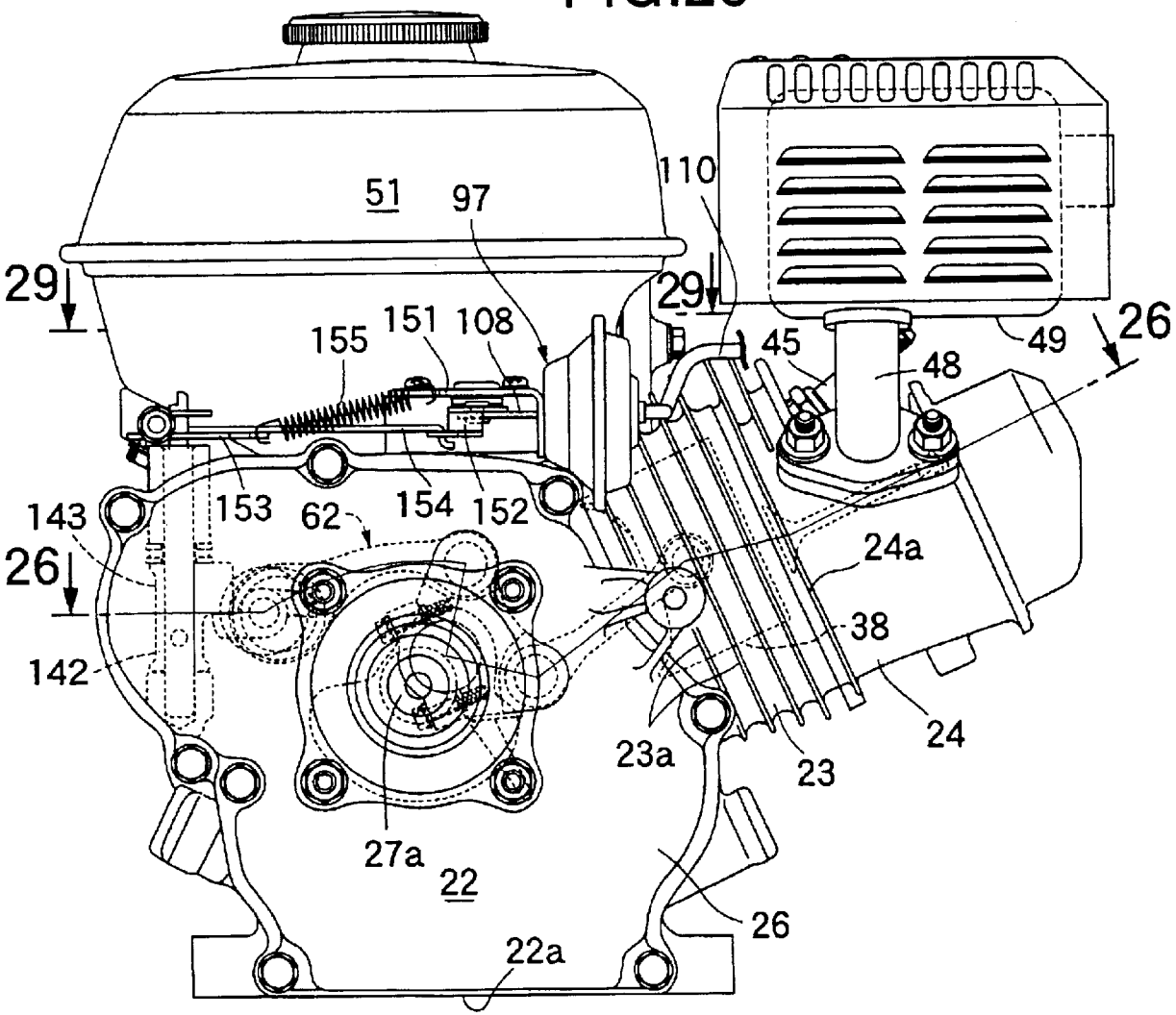
FIG. 25 is a front view of an engine according to a fifth embodiment of the present invention.
Figure 26:
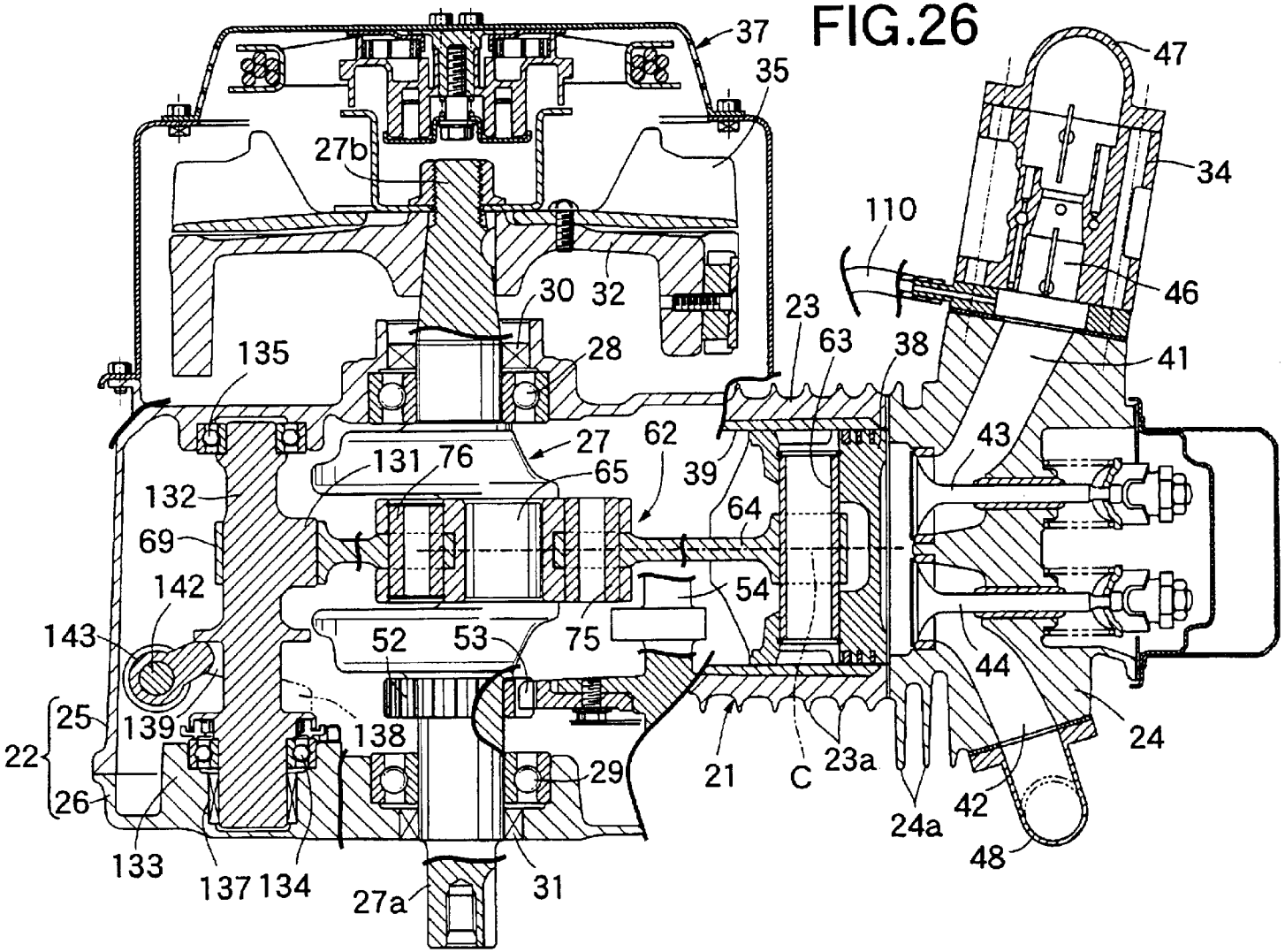
FIG. 26 is a cross-sectional view of the engine taken along line 26—26 in FIG. 25.
Figure 27:
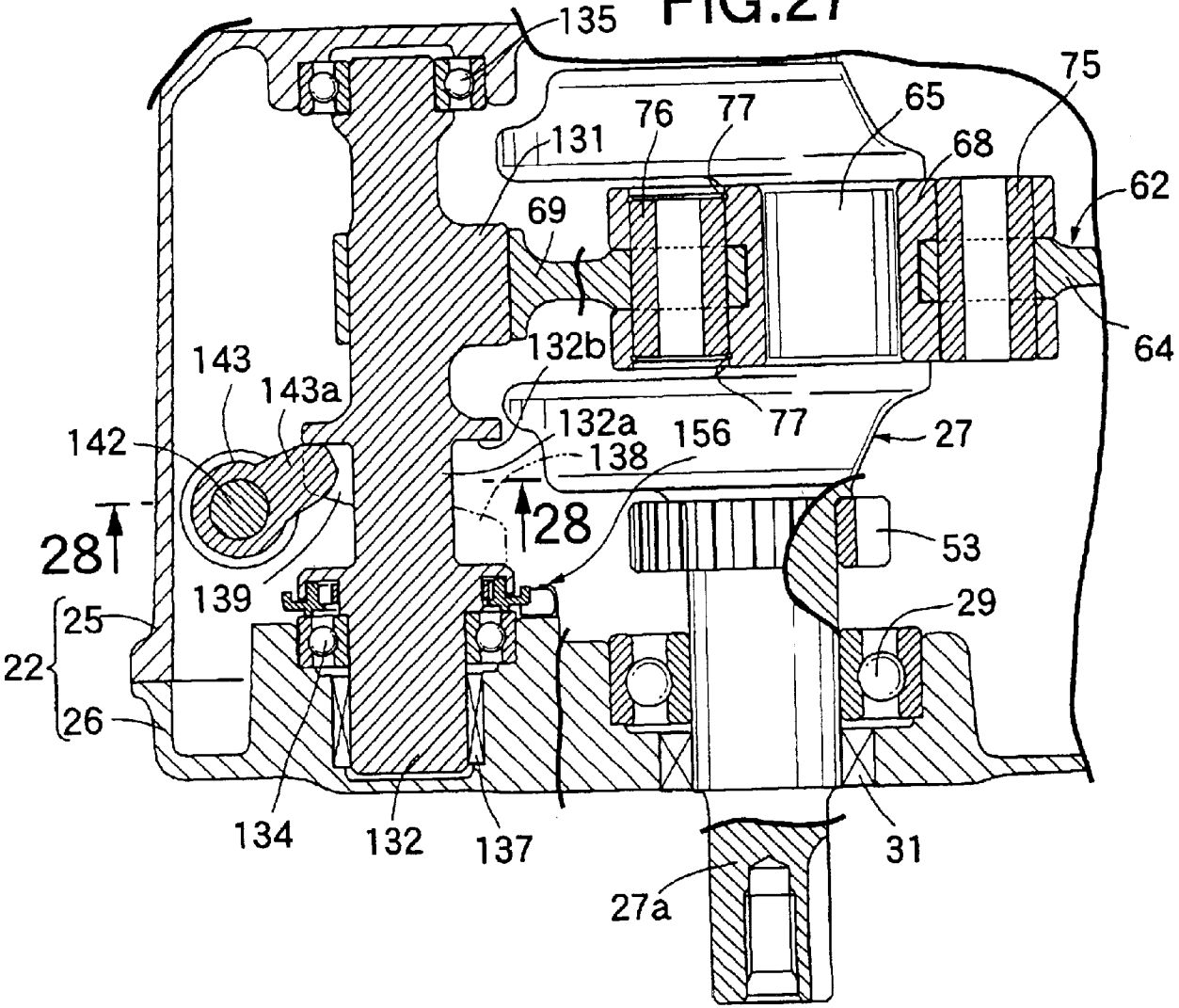
FIG. 27 is a magnified view of an essential part of the engine in FIG. 26.

The fifth embodiment of the present invention is now explained by reference to FIGS. 25 to 32. Referring firstly to FIGS. 25 to 27, the piston 38, the crankshaft 27, and a support shaft 131 are connected together via the link mechanism 62. The support shaft 131 is supported in the crankcase 22 of the engine main body 21 so as to shift within a plane that contains the cylinder axis C and is perpendicular to the axis of the crankshaft 27.

The cylindrical support shaft 131 is provided integrally with and positioned eccentrically relative to a rotating shaft 132 that has an axis parallel to the crankshaft 27 and is swingably supported in the crankcase 22 of the engine main body 21. One end of the rotating shaft 132 is swingably supported via a ball bearing 134 in a bottomed cylindrical bearing housing 133 provided in the side cover 26 of the crankcase 22. The other end of the rotating shaft 132 is swingably supported via a ball bearing 135 in the case main body 25 of the crankcase 22. A one-way clutch 137 is provided between the bearing housing 133 and the rotating shaft 132. The clutch 137 is outside the ball bearing 134.

A load in a direction in which the control rod 69 is compressed and a load in a direction in which the control rod 69 is pulled, alternately act on the control rod 69, which is connected at said other end to the support shaft 131, according to the running cycle of the engine. Since the support shaft 131 is provided so as to be positioned eccentrically relative to the rotating shaft 132, the rotating shaft 132 also alternately receives from the control rod 69 a rotational force in one direction and a rotational force in the other direction. However, since the one-way clutch 137 is disposed between the rotating shaft 132 and the bearing housing 133 in the side cover 26 of the crankcase 22, the rotating shaft 132 only rotates in one direction.

Figure 28:
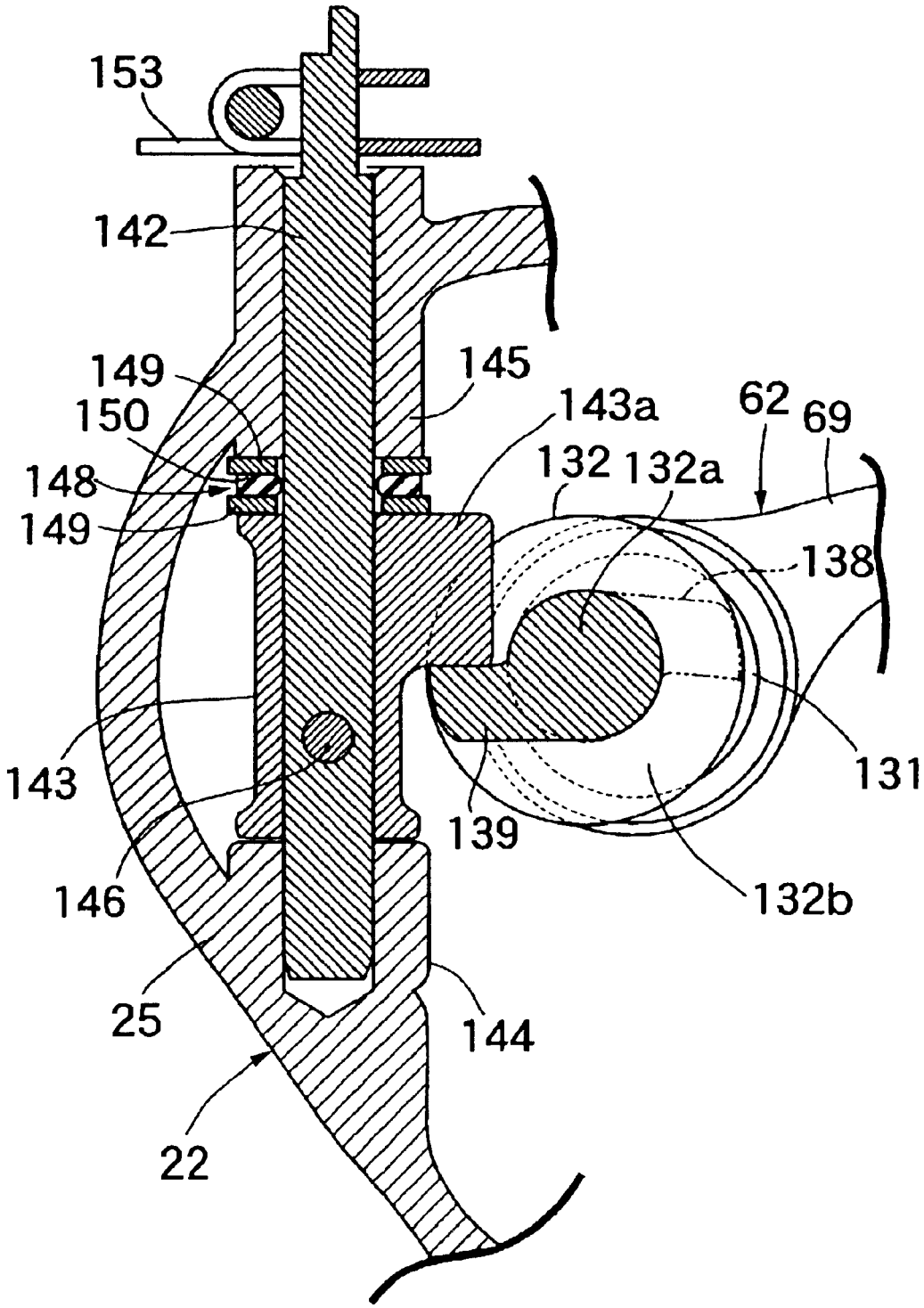
FIG. 28 is a cross-sectional view of the engine taken along line 28—28 in FIG. 27.

Referring also to FIG. 28, a small diameter shaft portion 132*a* is coaxially provided on the rotating shaft 132 at a position apart from the support shaft 131 in the axial direction so that an annular recess 132*b* is formed on the outer periphery of the small diameter shaft portion 132*a*. Engagement portions 138, 139 having phases displaced from each other are projectingly and integrally provided on the small diameter shaft portion 132*a* at a plurality of, for example, two, locations separate from each other in the axial direction.

Swingably supported in the crankcase 22 is a shaft member 142 having an axis perpendicular to the axis of the rotating shaft 132. That is, a bottomed cylindrical shaft support portion 144 and a cylindrical shaft support portion 145 are provided integrally in the case main body 25 of the crankcase 22 so that they face each other with a gap therebetween on an axis perpendicular to the axis of the rotating shaft 132. That is, the shaft member 142 is swingably supported by both shaft support portions 144, 145 with one end of the shaft member 142 disposed on the support shaft portion 144 side and the other end of the shaft member 142 projecting outward from the shaft support portion 145.

Attached to the support shaft 142 is a restricting member 143 operated within a plane perpendicular to the axis of the shaft member 142. In this embodiment, the restricting member 143 disposed between the two shaft support portions 144, 145, is fixed to the shaft member 142 by, for example, a pin 146. That is, the restricting member 143 swings together with the shaft member 142. A restricting projection 143*a* is integrally provided on the restricting member 143. The restricting projection 143*a* projects into the interior of the annular recess 132*b* and selectively abuts against and engages the engagement portions 138, 139.

When switching between a state in which the restricting projection 143*a* of the restricting member 143 abuts against one of the two engagement portions 138, 139 and a state in which the restricting projection 143*a* abuts against the other one of the two engagement portions 138, 139, the rotating shaft 132 swings due to the load acting on the control rod 69 connected to the support shaft 131 so as to be positioned eccentrically relative to the rotating shaft 132. Thus, it is necessary to prevent the swinging from causing one of the two engagement portions 138, 139 to abut against the restricting projection 143*a* of the restricting member 143 with any impact. Thrust cushioning means 148 is therefore disposed between the restricting member 143 and the shaft support portion 145 of the crankcase 22. The thrust cushioning means 148 alleviates the impact along the axial direction when the restricting member 143 is made to selectively abut against the selected one of the engagement portions 138, 139.

The thrust cushioning means 148 is formed by sandwiching a ring-shaped rubber 150 between a pair of washers 149, through which the shaft member 142 runs. The rubber 150 has oil resistance, heat resistance and high hardness and is baked onto the washers 149.

Figure 29:
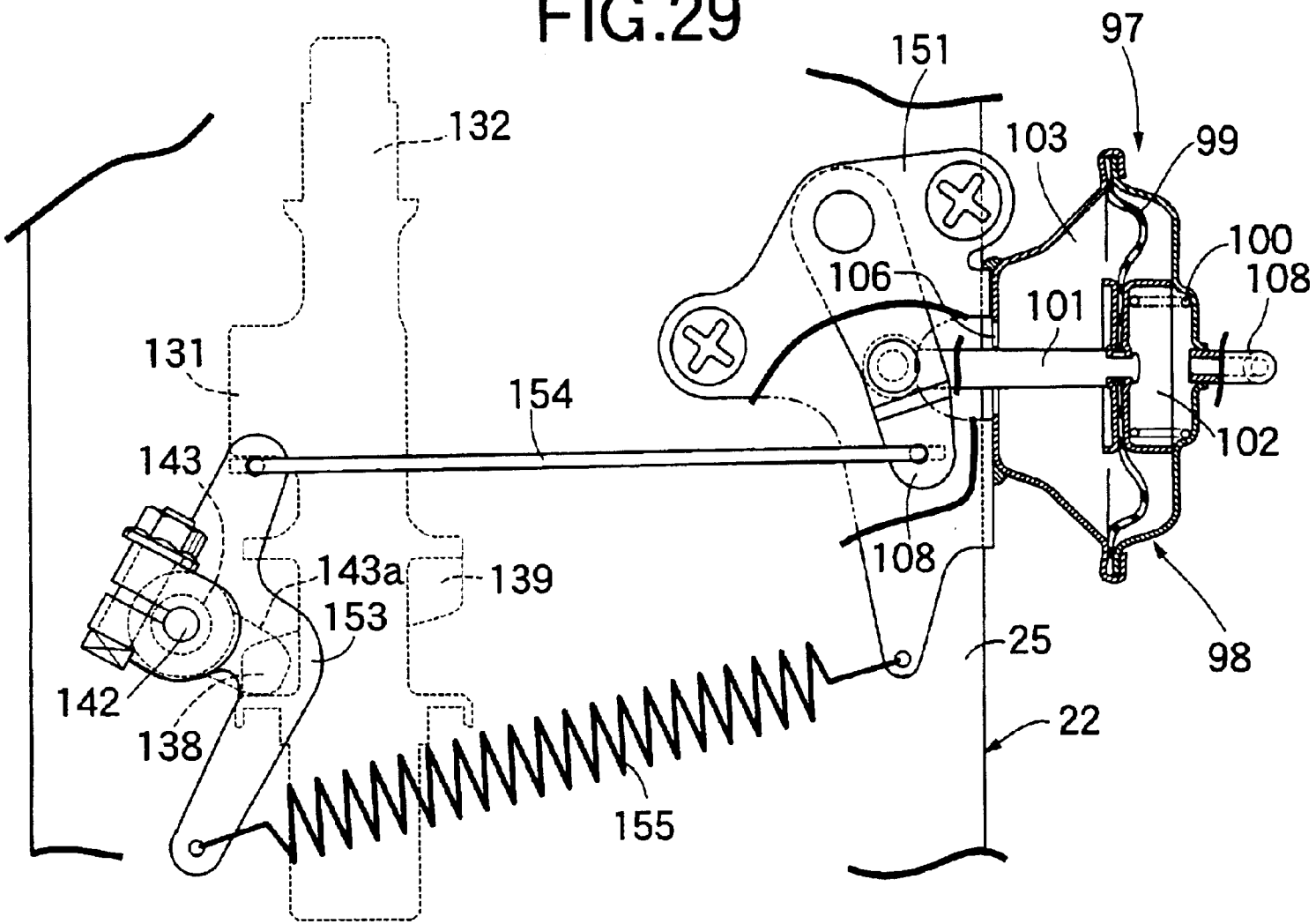
FIG. 29 is a partially cut-away plan view of the engine taken along line 29—29 in FIG. 25 with the engine in a light load state.

Referring also to FIG. 29, connected to the shaft member 142 is the diaphragm-type actuator 97, which is supported by a support plate 151 fixed to the case main body 25 of the crankcase 22. The operating rod 101 of the actuator 97 is connected to a drive arm 152 swingably supported by the support plate 151 around an axis parallel to the shaft member 142. A driven arm 153 is fixed to the other end of the shaft member 142 projecting from the crankcase 22. The drive arm 152 and the driven arm 153 are connected to each other via a connecting rod 154. Provided between the driven arm 153 and the support plate 151 is a spring 155 that biases the driven arm 153 to swing in an anticlockwise direction, as shown in FIG. 29. The shaft member 142 is biased to swing in one circumferential direction by the spring force of the spring 155.

When the engine is running in a light load state and the negative pressure of the negative pressure chamber 102 is high, the diaphragm 99 flexes to decrease the volume of the negative pressure chamber 102 against the spring forces of the return spring 100 and the spring 155, as shown in FIG. 29, so that the operating rod 101 contracts. In this state, the positions to which the shaft member 142 and the restricting member 143 swing are where the restricting projection 143*a* of the restricting member 143 abuts against and engages the engagement portion 138 of the rotating shaft 132.

Figure 30:
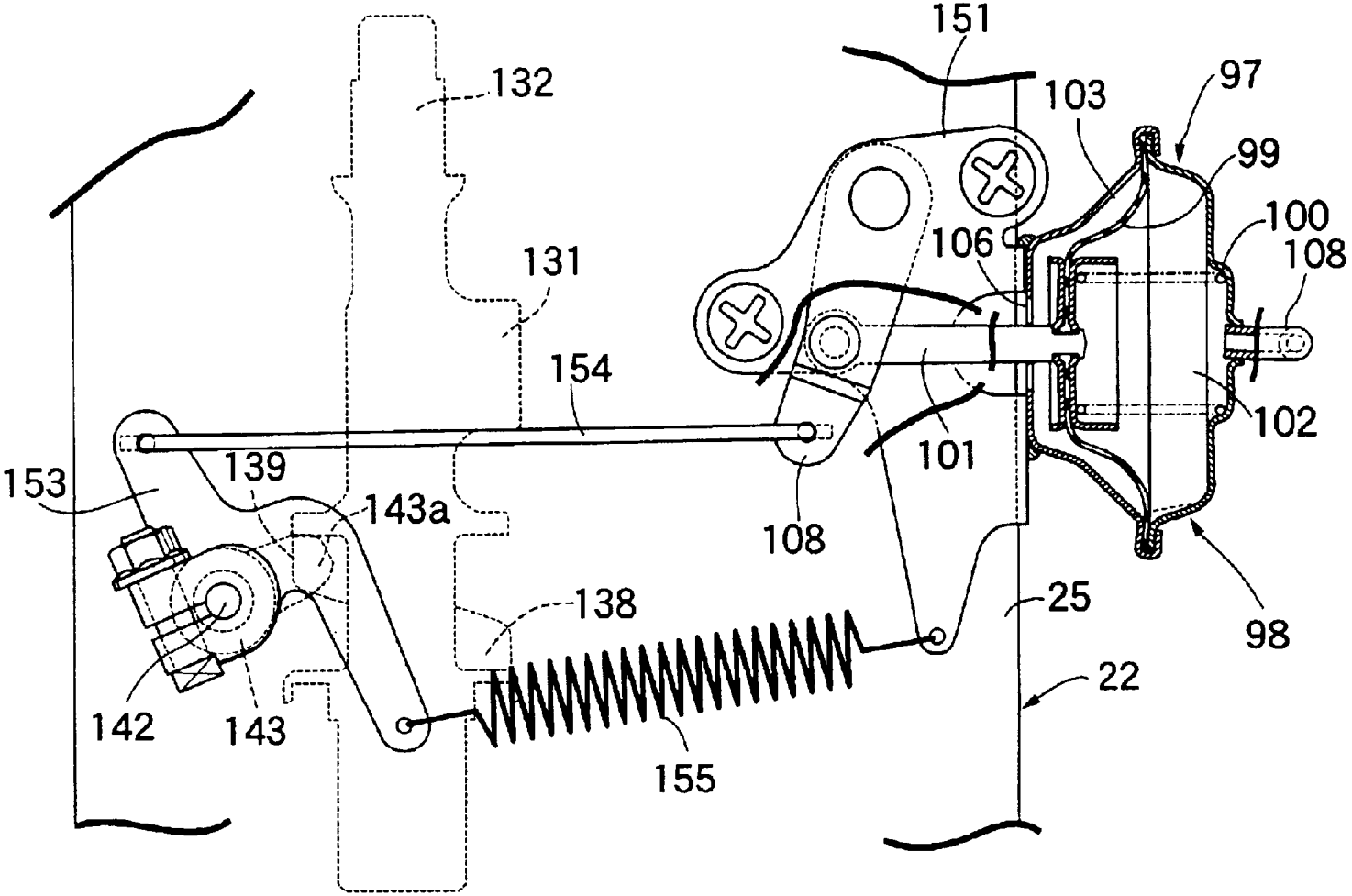
FIG. 30 is a view corresponding to FIG. 29 but with the engine in a heavy load state.

When the engine is running in a heavy load state and the negative pressure of the negative pressure chamber 102 becomes low, the diaphragm 99 flexes due to the spring forces of the return spring 100 and the spring 155 so as to increase the volume of the negative pressure chamber 102, as shown in FIG. 30, so that the operating rod 101 extends. The shaft member 142 and the restricting member 143 are thereby made to swing so that the restricting projection 143*a* of the restricting member 143 abuts against and engages the engagement portion 139 of the rotating shaft 132.

Swinging the restricting member 143 around the axis of the shaft member 142 in this way restricts swinging of the rotating shaft 132 at a position where either one of the engagement portions 138, 139 is engaged with the restricting projection 143*a* of the restricting member 143. A swinging force in one direction acts on the rotating shaft 132 while the engine is running. The rotating shaft 132 stops swinging at two positions having phases displaced from each other by, for example, 167 degrees. Thus, the support shaft 131 positioned eccentrically relative to the axis of the rotating shaft 132, that is, the other end of the control rod 69, shifts between the two positions within a plane perpendicular to the axis of the crankshaft 27, thereby changing the compression ratio of the engine.

Figure 31:
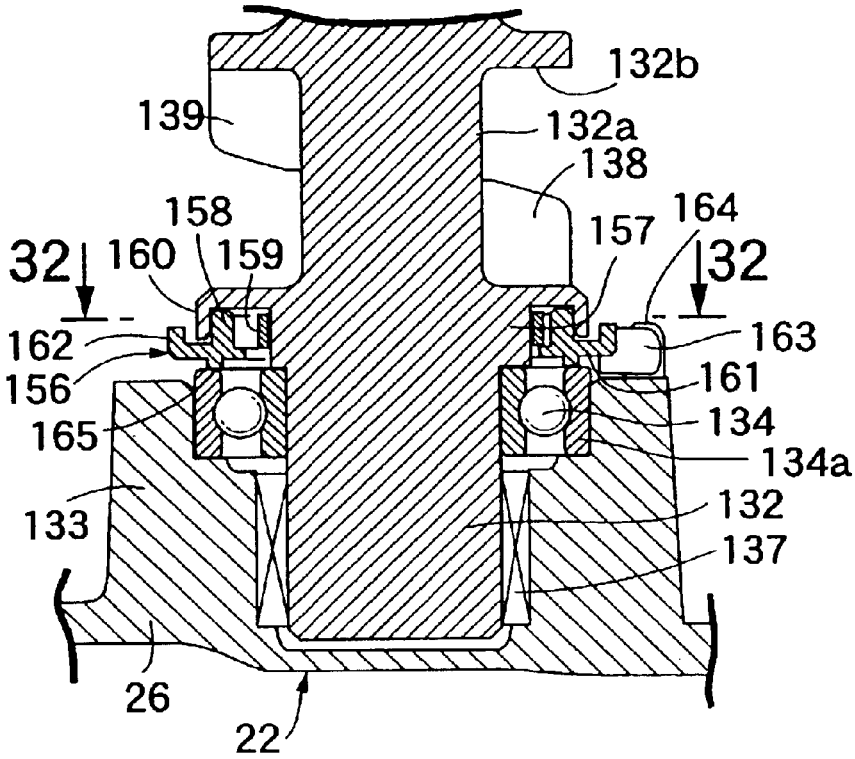
FIG. 31 is a magnified cross-sectional view showing the vicinity of one end of a rotating shaft.
Figure 32:
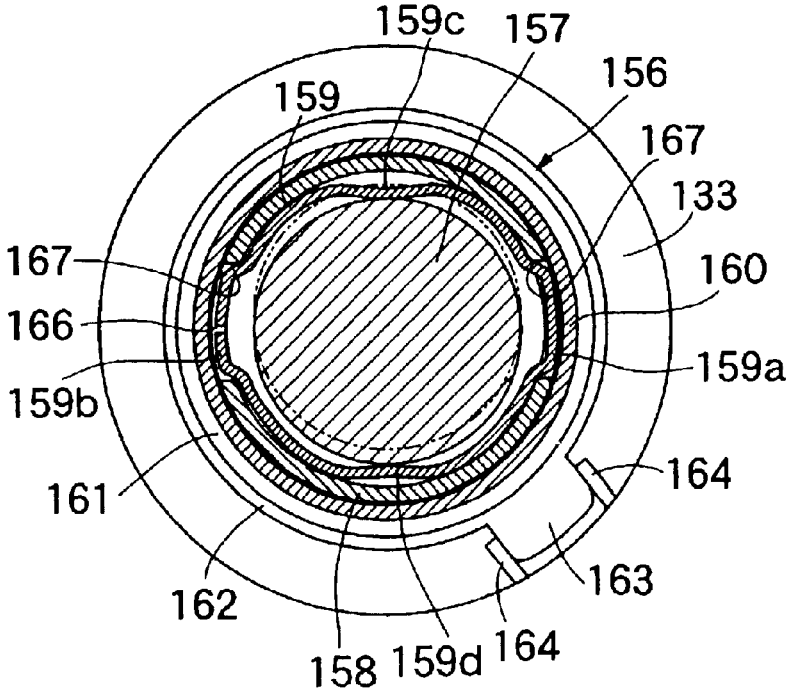
FIG. 32 is a cross sectional view of the engine taken along line 32—32 in FIG. 31.

Referring to FIGS. 31 and 32, in order to prevent the swinging of the rotating shaft 132 from causing the selected one of the engagement portions 138, 139 to abut against the restricting projection 143*a* of the restricting member 143 with any impact when switching over the compression ratio, radial cushioning means 156 for relieving the load in the radial direction exerted by the control rod 69 on the rotating shaft 132 is provided between the one end of the rotating shaft 132 and the bearing housing 133 of the crankcase 22 of the engine main body 21.

The radial cushioning means 156 includes an eccentric cam 157, a spring holder 158, and a compression spring 159 retained by the spring holder 158 so as to be in frictional contact with the eccentric cam 157. The eccentric cam 157 is integrally provided on the rotating shaft 132 so as to adjoin the small diameter shaft portion 132*a* on the ball bearing 134 side. The spring holder 158 surrounds the eccentric cam 157 and engages the bearing housing 133 so that the spring holder 158 is prevented from rotating around the axis of the rotating shaft 132.

Coaxially provided on the rotating shaft 132 is a cylindrical portion 160 surrounding the eccentric cam 157. The cylindrically formed spring holder 158 is slidably fitted into the cylindrical portion 160. Provided so as to be connected to the spring holder 158 is a ring-shaped support plate portion 161 facing the ball bearing 134 and the bearing housing 133. Projectingly provided integrally on the outer peripheral end of the support plate portion 161 are an annular projection 162 and an engagement plate portion 163. The annular projection 162, together with the spring holder 158, forms an annular channel therebetween into which the extremity of the cylindrical portion 160 is inserted. The engagement plate portion 163 projects radially outward at one location in the circumferential direction.

The engagement plate portion 163 is sandwiched between a pair of retaining plate portions 164 projectingly provided on the end face of the bearing housing 133. Accordingly, the spring holder 158 is prevented from rotating around the axis of the rotating shaft 132. Projectingly and integrally provided on the support plate portion 161 is an annular abutment portion 165 that abuts against and is supported by an outer ball race 134*a* of the ball bearing 134.

The compression spring 159 is formed in a substantially endless shape having a split 166 at one location in the circumferential direction. Formed on the compression spring 159 are engagement portions 159*a*, 159*b* and a pair of flexible abutment portions 159*c*, 159*d*. The engagement portions 159*a*, 159*b* protrude outward in the radial direction into a trapezoidal shape so as to engage a pair of engagement holes 167 provided in the spring holder 158 on a common diameter of the rotating shaft 132. The pair of flexible abutment portions 159*c*, 159*d* flex inward in the radial direction so as to make resilient sliding contact with the eccentric cam 157. The flexible abutment portions 159*c*, 159*d* are positioned at two locations on a straight line perpendicular to a straight line passing through both engagement portions 159*a*, 159*d*.

In the radial cushioning means 156, the eccentric cam 157 swings while flexing one of the flexible abutment portions 159*c*, 159*d* when the rotating shaft 132 swings. Thus, the load from the control rod 69 that acts in the radial direction on the rotating shaft 132 when switching over the compression ratio is alleviated. Moreover, combustion of the engine is used when switching over from a low compression ratio to a high compression ratio so that a greater force acts on the rotating shaft 132. Therefore, among the flexible abutment portions 159*c* and 159*d*, the flexible abutment portion 159*c* which comes into contact with the eccentric cam 157 when switching over from the low compression ratio to the high compression ratio, has an initial amount of deformation larger than that of the flexible abutment portion 159*d*. As a result, the force acting on the rotating shaft 132 when switching over from the low compression ratio to the high compression ratio is effectively further reduced, and an unnecessary swing resisting torque is prevented from acting on the rotating shaft 132 when switching over from the high compression ratio to the low compression ratio.

The operation of the fifth embodiment is now explained. The swing direction of the rotating shaft 132, having the relatively eccentric positioned support shaft 131 connected to the control rod 69, is restricted to one direction by the one-way clutch 137 provided between the rotating shaft 132 and the side cover 26 of the crankcase 22 of the engine main body 21. Since the pulling load and the compression load act on the control rod 69 due to combustion and inertia of the engine, the rotating shaft 132 and the support shaft 131 swing in the direction restricted by the one-way clutch 137 when the compression ratio is switched over.

The restricting projection 143*a* of the restricting member 143, which is fixed to the shaft member 142 swingably supported on the crankcase 22 of the engine main body 21 with the axis of the shaft member 142 perpendicular to the rotating shaft 132, selectively abuts against and engages the engagement portions 138, 139 provided at two locations, separate from each other in the axial direction, of the rotating shaft 132 so as to have phases displaced from each other. Moreover, the shaft member 142 is swung by the actuator 97. Therefore, it becomes possible for the other end of the control rod 69 to shift between the positions corresponding to a low compression ratio and a high compression ratio.

Furthermore, since the diaphragm type actuator 97 is operated by the negative pressure of the intake passage within the carburetor 34, the position of the control rod 69 can be changed with minimal power loss of the engine while avoiding an increase in the dimensions of the engine and complication of the arrangement thereof.

When one of the engagement portions 138, 139 contacts the restricting projection 143*a* of the restricting member 143, a force acts on the restricting member 143 in a direction perpendicular to the axis of the rotating shaft 132. However, the force is alleviated by the arrangement in which the thrust cushioning means 148 is disposed between the restricting member 143 and the shaft support portion 145 of the case main body 25. This arrangement avoids the force on the actuator 97 that operates the restricting member 143; improves durability and reliability while avoiding an increase in the dimensions arising from attempting to increase the strength of the rotating shaft 132 and members, such as the restricting member 143; and suppresses the noise generated when one of the engagement portions 138, 139 contacts the restricting member 143.

Furthermore, the radial cushioning means 156 is provided between the rotating shaft 132 and the side cover 26 of the crankcase 22 of the engine main body 21. The radial cushioning means 156 relieves the load, in the radial direction, acting on the rotating shaft 132 from the control rod 69.

As a result, even when a large load acts on the rotating shaft 132 when switching over the compression ratio, the load acting on the rotating shaft 132 in the radial direction is relieved by the radial cushioning means 156. The durability and reliability are improved while avoiding an increase in the dimensions due to attempting to increase the strength of the rotating shaft 132 and members, such as the restricting member 143. Furthermore, the noise generated when restricting the swing position of the rotating shaft 132 is suppressed.

Figure 33:
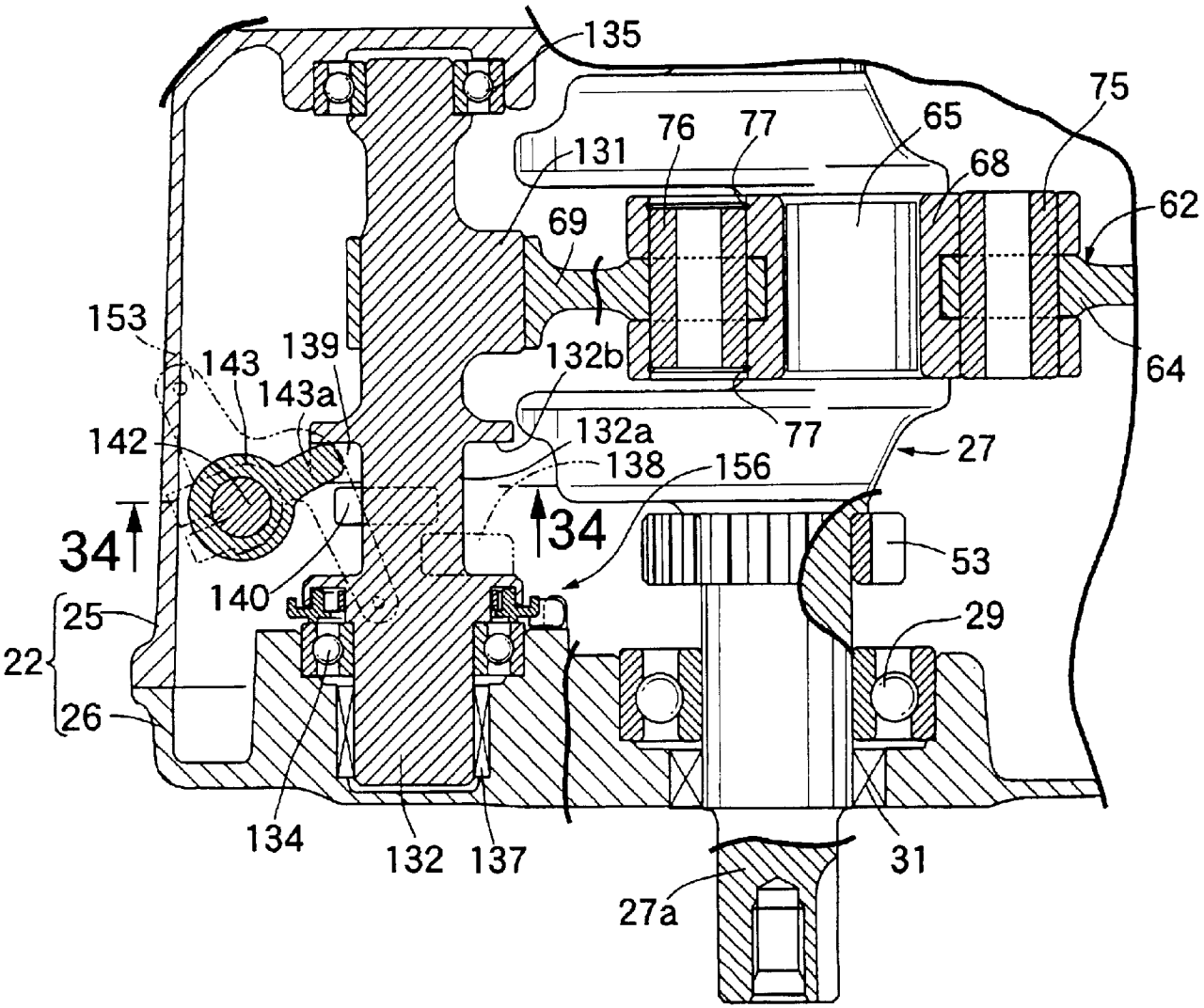
FIG. 33 is a cross-sectional view corresponding to FIG. 27 but according to a sixth embodiment of the present invention.
Figure 34:
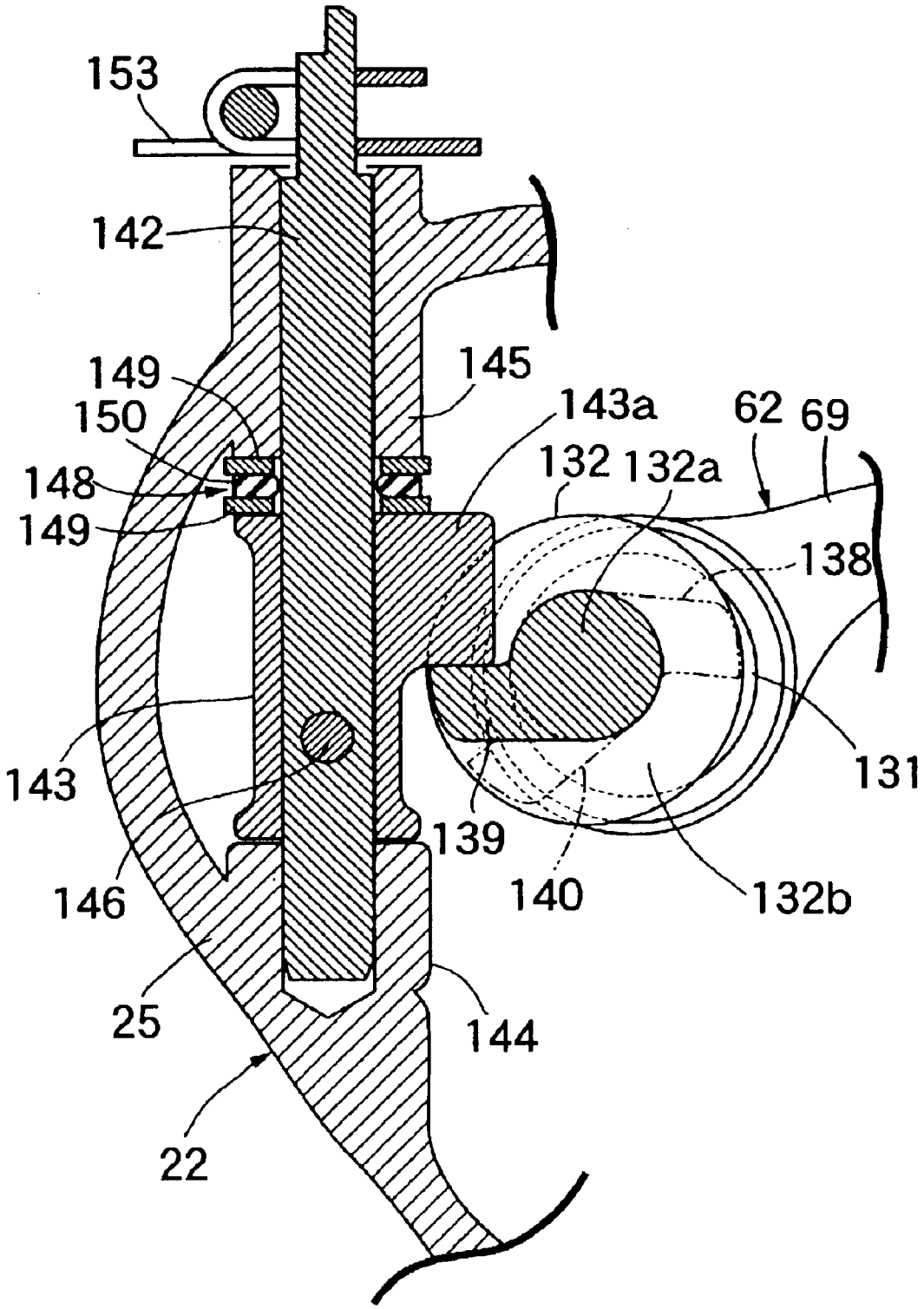
FIG. 34 is a cross sectional view of the engine taken along line 34—34 in FIG. 33.

The sixth embodiment of the present invention is now explained by reference to FIGS. 33 and 34. Engagement portions 138, 139, 140 with phases displaced from each other are projectingly and integrally provided at three locations on the small diameter shaft portion 132*a* of the rotating shaft 132 and separated from each other in the axial direction.

Swingably attached to the case main body 25 of the crankcase 22 is the shaft member 142 having an axis perpendicular to the axis of the rotating shaft 132. Integrally provided on the restricting member 143 fixed to the shaft member 142 by the pin 146 is a restricting projection 143*a* that projects into the interior of the annular recess 132*b* and selectively abuts against and engages the engagement portions 138, 139, 140.

In accordance with the sixth embodiment, swinging the shaft member 142 allows the compression ratio to vary with finer or more accurate differentiation, thereby changing the compression ratio so as to correspond to a light load, a medium load, and a heavy load of the engine.

Figure 35:
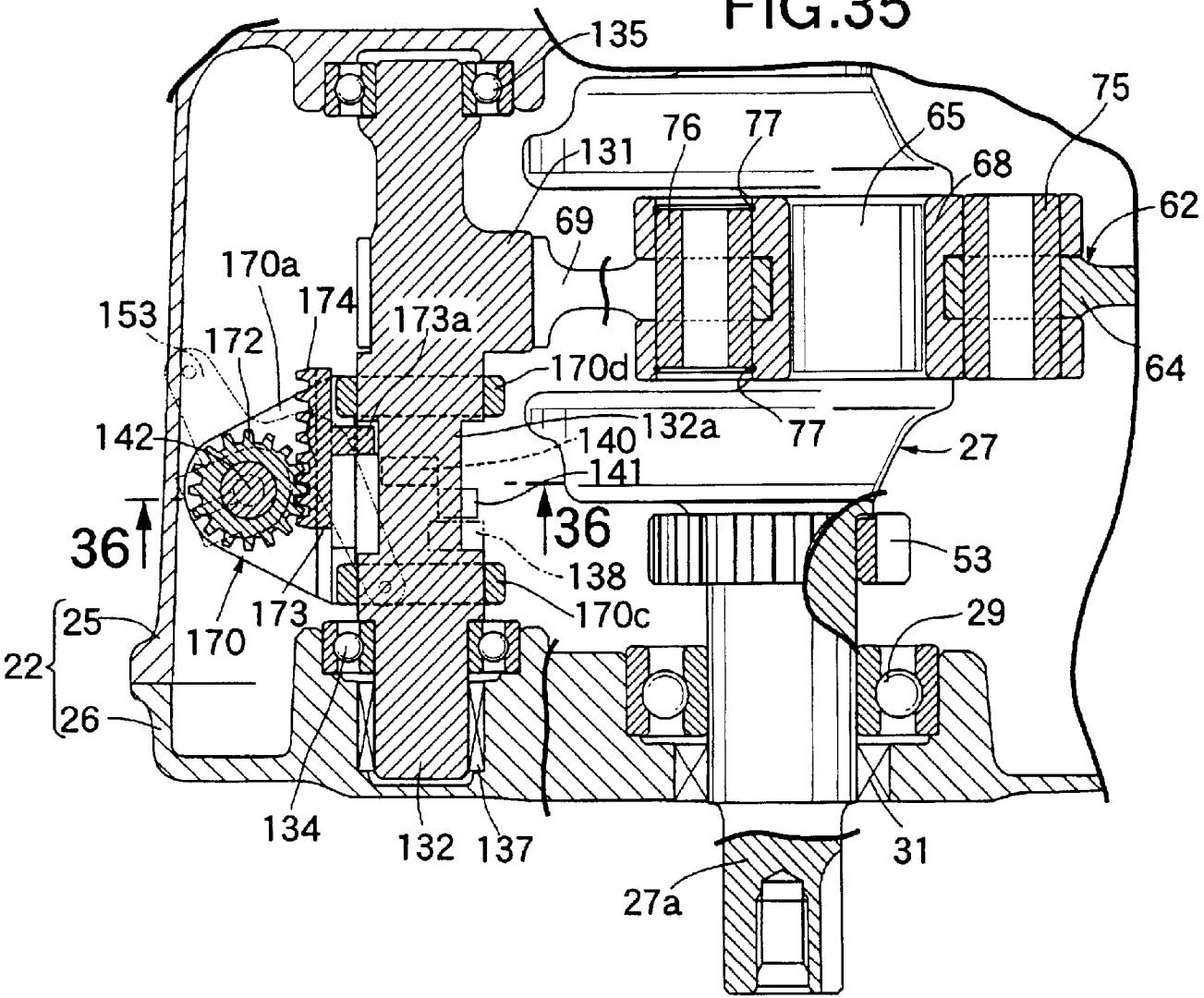
FIG. 35 is a cross-sectional view corresponding to FIG. 27 but according to a seventh embodiment of the present invention.
Figure 36:
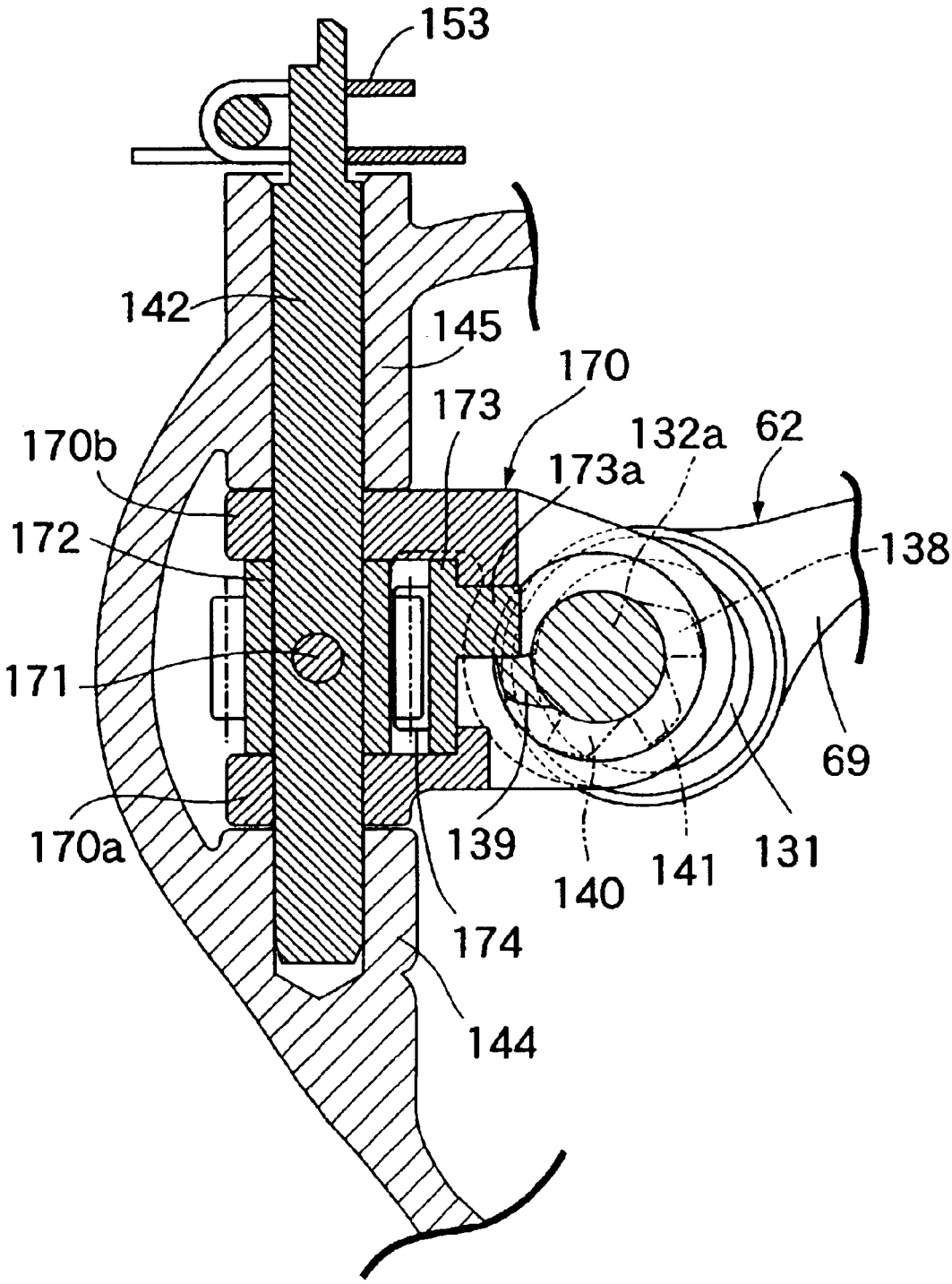
FIG. 36 is a cross sectional view of the engine taken along line 36—36 in FIG. 35.

The seventh embodiment of the present invention is now explained by reference to FIGS. 35 and 36. Engagement portions 138, 139, 140, 141 with phases displaced from each other are projectingly and integrally provided at four locations on the small diameter shaft portion 132*a* of the rotating shaft 132 and separated from each other in the axial direction.

A guide member 170 is attached to the shaft member 142 swingably supported in the case main body 25 of the crankcase 22. The guide member 170 includes support plates 170*a*, 170*b* facing the shaft support portions 144, 145 integrally provided on the case main body 25. Integrally provided on the guide member 170 on opposite sides of the small diameter shaft portion 132*a* are support plates 170*c*, 170*d* through which the rotating shaft 132 rotatably runs. That is, the guide member 170 is attached to the shaft member 142 in a state in which the guide member 170 is prevented from swinging around the axis of the shaft member 142 and from moving in the axial direction.

A pinion 172 is fixed by means of, for example, a pin 171 to the shaft member 142 between the two support plates 170*a*, 170*b* of the guide member 170. Supported on the guide member 170 is a restricting member 173 that integrally includes a restricting projection 173*a* that selectively engages the engagement portions 138, 139, 140, 141 of the rotating shaft 132. The restricting member 173 is movable in a direction along the axis of the rotating shaft 132. A rack 174 meshing with the pinion 172 is provided on the restricting member 173.

In accordance with the seventh embodiment, swinging the shaft member 142 permits the restricting member 173 to operate steplessly or continuously in the direction along the axis of the rotating shaft 132, and selectively causes the restricting projection 173*a* to engage a larger number of engagement portions 138 to 141 to make the compression ratio vary with finer or more accurate differentiation.

Although embodiments of the present invention are explained above, the present invention is not limited by the above-mentioned embodiments and can be modified in a variety of ways without departing from the present invention described in the scope of claims.

What is claimed is:

1. A variable compression ratio engine wherein one end of a connecting rod is connected to a piston via a piston pin and the other end of the connecting rod is swingably connected to one end of a sub-rod that is in sliding contact with half of a periphery of a crankpin of a crankshaft, a crank cap in sliding contact with the other half of the periphery of the crankpin is secured to the sub-rod, and one end of a control rod is swingably connected to the other end of the sub-rod, wherein the other end of the control rod is swingably connected to a support shaft provided at a position eccentric relative to a rotating shaft that is swingably and axially supported in an engine main body via a one-way clutch, wherein an actuator is supported in the engine main body, the actuator is a diaphragm actuator in which a peripheral edge of a diaphragm is sandwiched by a casing, wherein respective opposite sides of the diaphragm face a negative pressure chamber in communication with an intake passage within a carburetor mounted on the engine main body and an atmospheric pressure chamber that is open to the atmosphere, wherein a restricting projection is provided on the rotating shaft at a location in a circumferential direction on the rotating shaft and projects outward in a radial direction, wherein a shaft member is provided in the engine main body so that an axis of the shaft member is perpendicular relative to the rotating shaft, wherein a rocker member is mounted on the shaft member and rocks around the axis of the shaft member, the rocker member having a pair of engagement portions which have phases displaced from each other and which engage the restricting projection, the rocker member being spring-biased in a direction in which one of the engagement portions engages the restricting projection, and wherein the actuator is connected to the rocker member so that the rocker member swings in a direction opposite to the spring-bias direction in response to an increase in a negative pressure of the negative pressure chamber.

2. The variable compression ratio engine according to claim 1 wherein each engagement portion includes a plurality of steps arranged in the circumferential direction of the rotating shaft, each step sequentially engages the restricting projection as the rotating shaft rotates.

3. A variable compression ratio engine wherein one end of a connecting rod is connected to a piston via a piston pin and the other end of the connecting rod is swingably connected to one end of a sub-rod that is in sliding contact with half of a periphery of a crankpin of a crankshaft, a crank cap in sliding contact with the remaining half of the periphery of the crankpin is secured to the sub-rod, and one end of a control rod is swingably connected to the other end of the sub-rod, wherein the other end of the control rod is swingably connected to a support shaft provided at a position eccentric relative to a rotating shaft that is swingably and axially supported in an engine main body via a one-way clutch, wherein an actuator is supported in the engine main body, the actuator is a diaphragm actuator in which a peripheral edge of a diaphragm is sandwiched by a casing, wherein respective opposite sides of the diaphragm face a negative pressure chamber in communication with an intake passage within a carburetor mounted on the engine main body and an atmospheric pressure chamber that is open to the atmosphere, wherein engagement portions with phases displaced from each other are provided at a plurality of locations on the rotating shaft in the axial direction, wherein a shaft member is supported in the engine main body and an axis of the shaft member is perpendicular relative to the rotating shaft, wherein a restricting member with a restricting projection that selectively engages the plurality of engagement portions is mounted on the shaft member and the restricting projection is operated within a plane that is perpendicular relative to the axis of the shaft member, and wherein the actuator is connected to the restricting member and drives the restricting member within the plane.

4. The variable compression ratio engine according to claim 3 wherein the shaft member swung by the actuator is supported on the engine main body and swings around the axis of the shaft member, and wherein a rack is provided on the restricting member that moves in a direction along the axis of the rotating shaft, the rack meshing with a pinion fixedly provided on the shaft member.

* * * * *